US011950670B2

(12) United States Patent
Yang et al.

(10) Patent No.: US 11,950,670 B2
(45) Date of Patent: Apr. 9, 2024

(54) WATERPROOF CONTAINER ADAPTED FOR AN ELECTRONIC DEVICE WITH A TOUCH SCREEN

(71) Applicant: Universal Trim Supply Co., Ltd., New Taipei (TW)

(72) Inventors: Chih-Wei Yang, Taipei (TW); Shih-Sheng Yang, Taipei (TW); Hou-Chun Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 330 days.

(21) Appl. No.: 17/562,025

(22) Filed: Dec. 27, 2021

(65) Prior Publication Data

US 2023/0200509 A1 Jun. 29, 2023

(51) Int. Cl.
*A45C 13/00* (2006.01)
*A45C 11/00* (2006.01)

(52) U.S. Cl.
CPC ..... *A45C 13/008* (2013.01); *A45C 11/00* (2013.01); *A45C 2011/002* (2013.01); *A45C 2200/10* (2013.01)

(58) Field of Classification Search
CPC ..... A45C 3/008
USPC ..... 174/50
See application file for complete search history.

(56) References Cited

U.S. PATENT DOCUMENTS

| | | | | |
|---|---|---|---|---|
| 8,624,111 | B2 * | 1/2014 | Tages | G06F 1/1628 455/575.8 |
| 2014/0152890 | A1 * | 6/2014 | Rayner | A45C 11/00 277/312 |
| 2014/0175961 | A1 * | 6/2014 | Wu | A45C 11/00 312/223.1 |
| 2018/0212640 | A1 * | 7/2018 | Burns | A45C 13/008 |
| 2021/0333880 | A1 * | 10/2021 | Junus | G06F 3/045 |
| 2021/0345744 | A1 * | 11/2021 | Rosario | A45C 13/002 |
| 2021/0382596 | A1 * | 12/2021 | Lee | G06F 3/04166 |
| 2022/0232938 | A1 * | 7/2022 | Poon | A45C 13/008 |

* cited by examiner

*Primary Examiner* — Stanley Tso
(74) *Attorney, Agent, or Firm* — Winston Hsu

(57) ABSTRACT

A waterproof container is adapted for an electronic device with a touch screen. The waterproof container includes an upper component and a lower component. The upper component includes a first layer, a second layer and a third layer. The second layer is disposed between the first layer and the third layer. A second touched part of the second layer is connected to a first touched part of the first layer by a plurality of first connections. The second touched part of the second layer is connected to a third touched part of the third layer by a plurality of second connections, and the plurality of first connections and the plurality of second connections are staggered relative to each other. The lower component is connected to the upper component. An accommodating space is enclosed by the lower component and the upper component for accommodating the electronic device.

27 Claims, 23 Drawing Sheets

WATERPROOF CONTAINER ADAPTED FOR AN ELECTRONIC DEVICE WITH A TOUCH SCREEN

BACKGROUND OF THE INVENTION

1. Field of the Invention

The present invention relates to a waterproof container, and more specifically, to a waterproof container adapted for an electronic device with a touch screen.

2. Description of the Prior Art

Electronic devices, such as mobile phones, may be damaged by water during outdoor activities. Therefore, there are various waterproof containers, such as a waterproof bag or a waterproof case, available in the market to protect the electronic devices from water damage. However, the conventional waterproof containers cannot allow a reliable operation of capacitive touch screens of the electronic devices underwater. Therefore, there is a need to provide an improved waterproof container adapted for an electronic device with a touch screen.

SUMMARY OF THE INVENTION

It is an objective of the present invention to provide a waterproof container adapted for an electronic device with a touch screen for solving the aforementioned problem.

In order to achieve the aforementioned objective, the present invention discloses a waterproof container adapted for an electronic device with a touch screen. The waterproof container includes an upper component and a lower component. The upper component includes a first layer, a second layer and a third layer. A second touched part of the second layer is disposed between a first touched part of the first layer and a third touched part of the third layer. The second touched part of the second layer is connected to the first touched part of the first layer by a plurality of first connections. The second touched part of the second layer is connected to the third touched part of the third layer by a plurality of second connections, and the plurality of first connections and the plurality of second connections are staggered relative to each other. The lower component is connected to the upper component. An accommodating space is enclosed by the lower component and the upper component for accommodating the electronic device.

According to an embodiment of the present invention, the first touched part of the first layer is separated from the third touched part of the third layer by the second touched part of the second layer and spaced from the third touched part of the third layer at a uniform distance.

According to an embodiment of the present invention, the plurality of first connections and the plurality of second connections are staggered relative to each other along a longitudinal direction of the upper component.

According to an embodiment of the present invention, the plurality of first connections and the plurality of second connections are line-shaped connections extending along a traverse direction of the upper component.

According to an embodiment of the present invention, the plurality of first connections and the plurality of second connections are staggered relative to each other along a longitudinal direction and a traverse direction of the upper component.

According to an embodiment of the present invention, the plurality of first connections and the plurality of second connections are dot-shaped connections.

According to an embodiment of the present invention, each of the first touched part of the first layer, the second touched part of the second layer and the third touched part of the third layer is formed in a wave-shaped structure.

According to an embodiment of the present invention, the waterproof container further includes a sealable opening structure for providing access to the accommodating space.

According to an embodiment of the present invention, the waterproof container further includes an inflating pump for inflating an enclosing space enclosed by the first layer and the third layer with a fluid by allowing the fluid to flow into the enclosing space enclosed by the first layer and the third layer.

According to an embodiment of the present invention, the accommodating space is enclosed by the lower component and the third layer, and the inflating pump inflates the enclosing space enclosed by the first layer and the third layer with the fluid by allowing the fluid to flow from the accommodating space enclosed by the lower component and the third layer to the enclosing space enclosed by the first layer and the third layer.

According to an embodiment of the present invention, the inflating pump inflates the enclosing space enclosed by the first layer and the third layer with the fluid by allowing the fluid to flow from an environment outside the waterproof container to the enclosing space enclosed by the first layer and the third layer.

According to an embodiment of the present invention, the waterproof container further includes a relief valve for deflating the enclosing space enclosed by the first layer and the third layer by allowing a fluid to flow out of the enclosing space enclosed by the first layer and the third layer.

According to an embodiment of the present invention, the accommodating space is enclosed by the lower component and the third layer, and the relief valve deflates the enclosing space enclosed by the first layer and the third layer by allowing the fluid to flow from the enclosing space enclosed by the first layer and the third layer to the accommodating space enclosed by the lower component and the third layer.

According to an embodiment of the present invention, the relief valve deflates the enclosing space enclosed by the first layer and the third layer by allowing the fluid to flow from the accommodating space enclosed by the lower component and the third layer to an environment outside the waterproof container.

According to an embodiment of the present invention, the upper component further includes a fourth layer. A fourth touched part of the fourth layer is connected to the third touched part of the third layer by a plurality of third connections, and the plurality of second connections and the plurality of third connections are staggered relative to each other.

According to an embodiment of the present invention, the upper component further includes a fifth layer. A fifth touched part of the fifth layer is connected to the fourth touched part of the fourth layer by a plurality of fourth connections, and the plurality of third connections and the plurality of fourth connections are staggered relative to each other.

According to an embodiment of the present invention, an enclosing space is enclosed by the first layer and the fifth layer, and the accommodating space is enclosed by the lower component and the fifth layer.

According to an embodiment of the present invention, the plurality of first connections and the plurality of second connections are staggered relative to each other along a longitudinal direction of the upper component and are line-shaped connections extending along a traverse direction of the upper component.

According to an embodiment of the present invention, the plurality of first connections and the plurality of second connections are staggered relative to each other along a longitudinal direction and a traverse direction of the upper component and are dot-shaped connections.

According to an embodiment of the present invention, each of the first touched part of the first layer, the second touched part of the second layer, the third touched part of the third layer, the fourth touched part of the fourth layer and the fifth touched part of the fifth layer is formed in a wave-shaped structure.

According to an embodiment of the present invention, the lower component is a flat film, and the waterproof container further includes a sealable opening structure disposed on the upper component for providing access to the accommodating space.

According to an embodiment of the present invention, the sealable opening structure includes an elastomeric protruding component and a covering assembly. The elastomeric protruding component protrudes from the upper component. A slit penetrates through the elastomeric protruding component and is communicated with the accommodating space. The covering assembly is configured to pivotally engage with the elastomeric protruding component to seal the slit.

According to an embodiment of the present invention, a surrounding wall protrudes from a first side of the lower component. An opening is enclosed by a connecting portion of the surrounding wall. The upper component is located at a position corresponding to the opening and connected to the connecting portion of the surrounding wall, and the waterproof container further includes a sealable opening structure disposed on the lower component for providing access to the accommodating space.

According to an embodiment of the present invention, the sealable opening structure includes an elastomeric protruding component and a covering assembly. The elastomeric protruding component protrudes from one of the first side of the lower component and a second side of the lower component opposite to the first side of the lower component. A slit penetrates through the elastomeric protruding component and is communicated with the accommodating space. The covering assembly is configured to pivotally engage with the elastomeric protruding component to seal the slit.

According to an embodiment of the present invention, the sealable opening structure further includes a first engaging component and a second engaging component. The first engaging component is pivotally coupled to the covering assembly. A pivoting axis of the first engaging component is parallel to a pivoting axis of the covering assembly and perpendicular to a normal direction of the one of the first side and the second side of the lower component. The second engaging component protrudes from another one of the first side and the second side of the lower component, and the first engaging component engages with the second engaging component for restraining the covering assembly from disengaging from the elastomeric protruding component.

According to an embodiment of the present invention, the waterproof container further includes a clip pivotally coupled to the another one of the first side and second side of the lower component. A pivoting axis of the clip is parallel to a normal direction of the another one of the first side and the second side of the lower component. The second engaging component is located between the clip and the lower component, and the clip is configured to pivotally reveal the second engaging component or pivotally cover the second engaging component.

According to an embodiment of the present invention, the waterproof container further includes a window. An aperture structure is formed on the lower component, and the window is disposed on the aperture structure.

In summary, in the present invention, when a touched portion of the upper component is collapsed by a user's finger underwater, an untouched portion of the upper component is not collapsed due to a staggered arrangement of the plurality of first connections and the plurality of second connections. Furthermore, when the fluid is forced by the user's finger to flow inside the enclosing space, the plurality of first connections and the plurality of second connections can prevent excessive inflation and excessive deflation of the untouched portion of the upper component, so as to prevent abnormal excessive accumulation and loss of the fluid to prevent collapse of the untouched portion of the upper component caused by the abnormal accumulation and loss of the fluid. Therefore, a first portion of the touch screen corresponding to the touch portion of the upper component is close to the user's finger, and a second portion of the touch screen corresponding to the untouched portion of the upper component is still away from water, which prevents a desired touch operation of the first portion of the touch screen from being interfered by an unintentional touch operation of the second portion of the touch screen caused by the water.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" and "coupled" is intended to mean either an indirect or direct mechanical connection. Thus, if a first device is connected or coupled to a second device, that connection may be through a direct mechanical connection, or through an indirect mechanical connection via other devices and connections.

Figure 1:
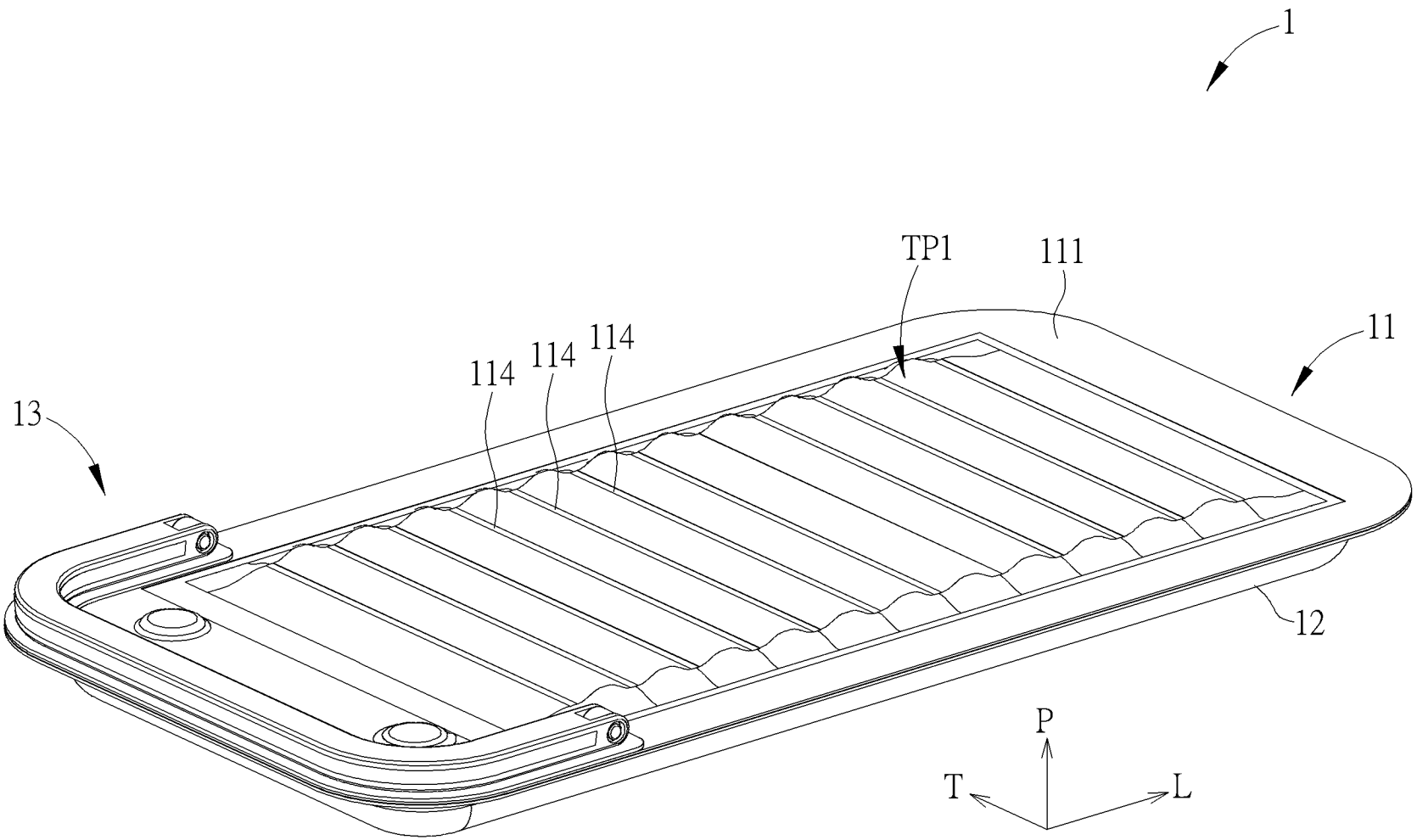
FIG. 1 is a schematic diagram of a waterproof container according to a first embodiment of the present invention.
Figure 2:
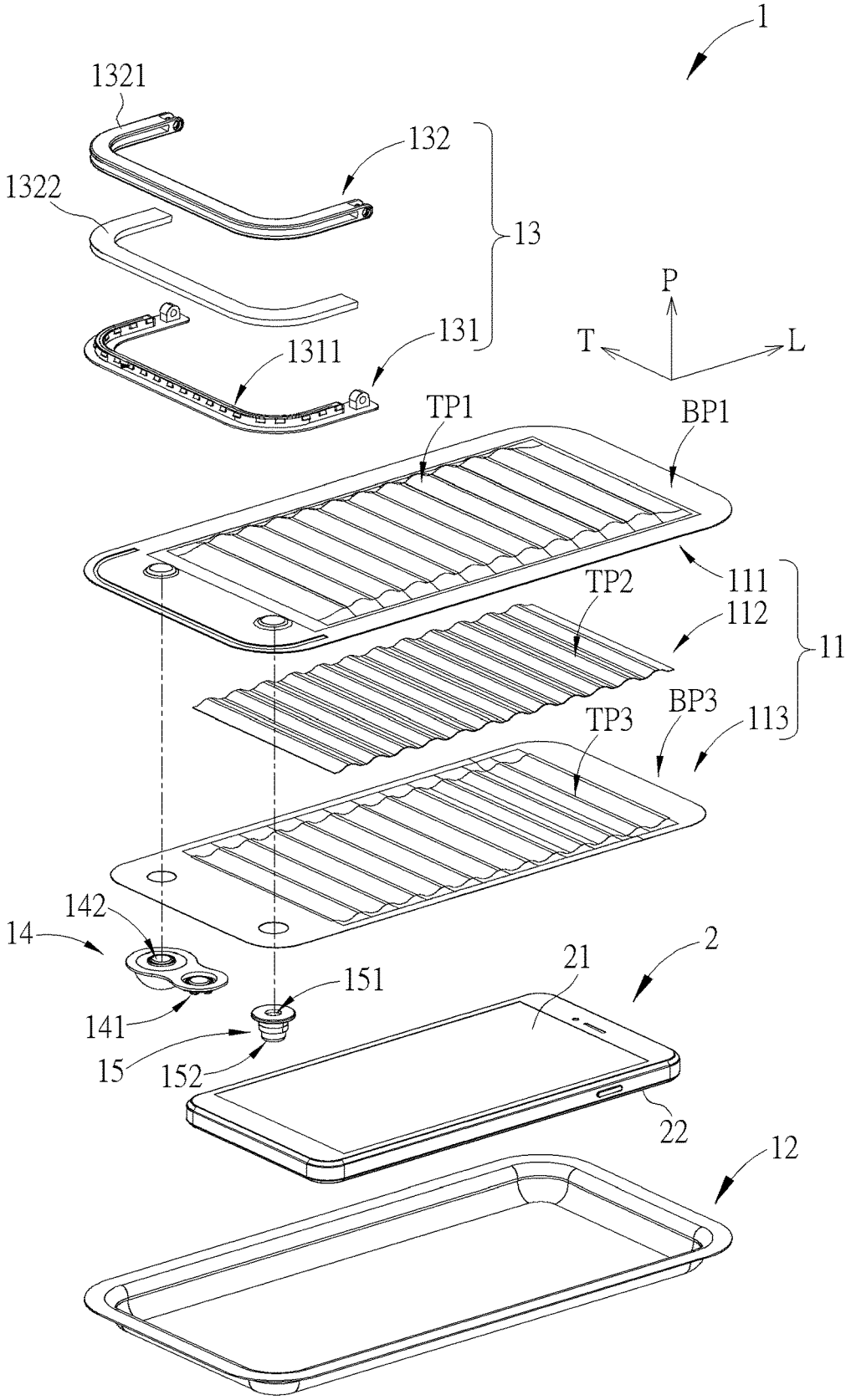
FIG. 2 is an exploded diagram of the waterproof container according to the first embodiment of the present invention.
Figure 3:
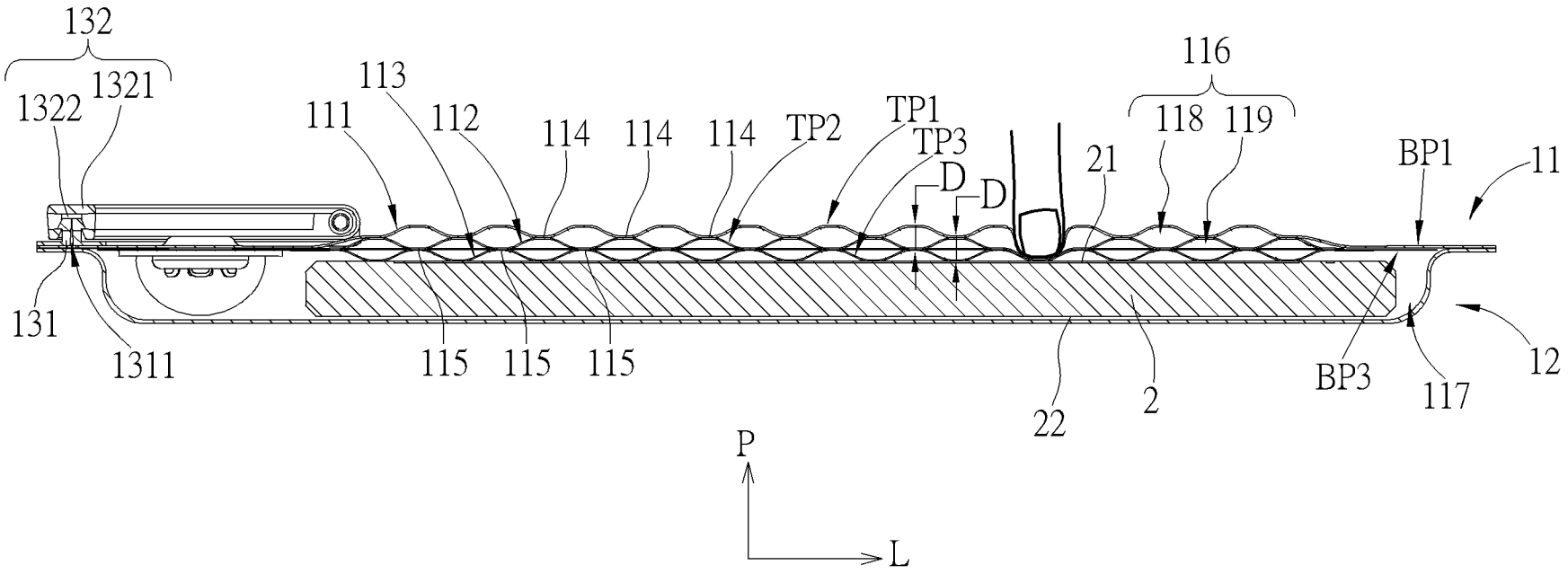
FIG. 3 is a sectional diagram of the waterproof container along a longitudinal direction according to the first embodiment of the present invention.
Figure 4:
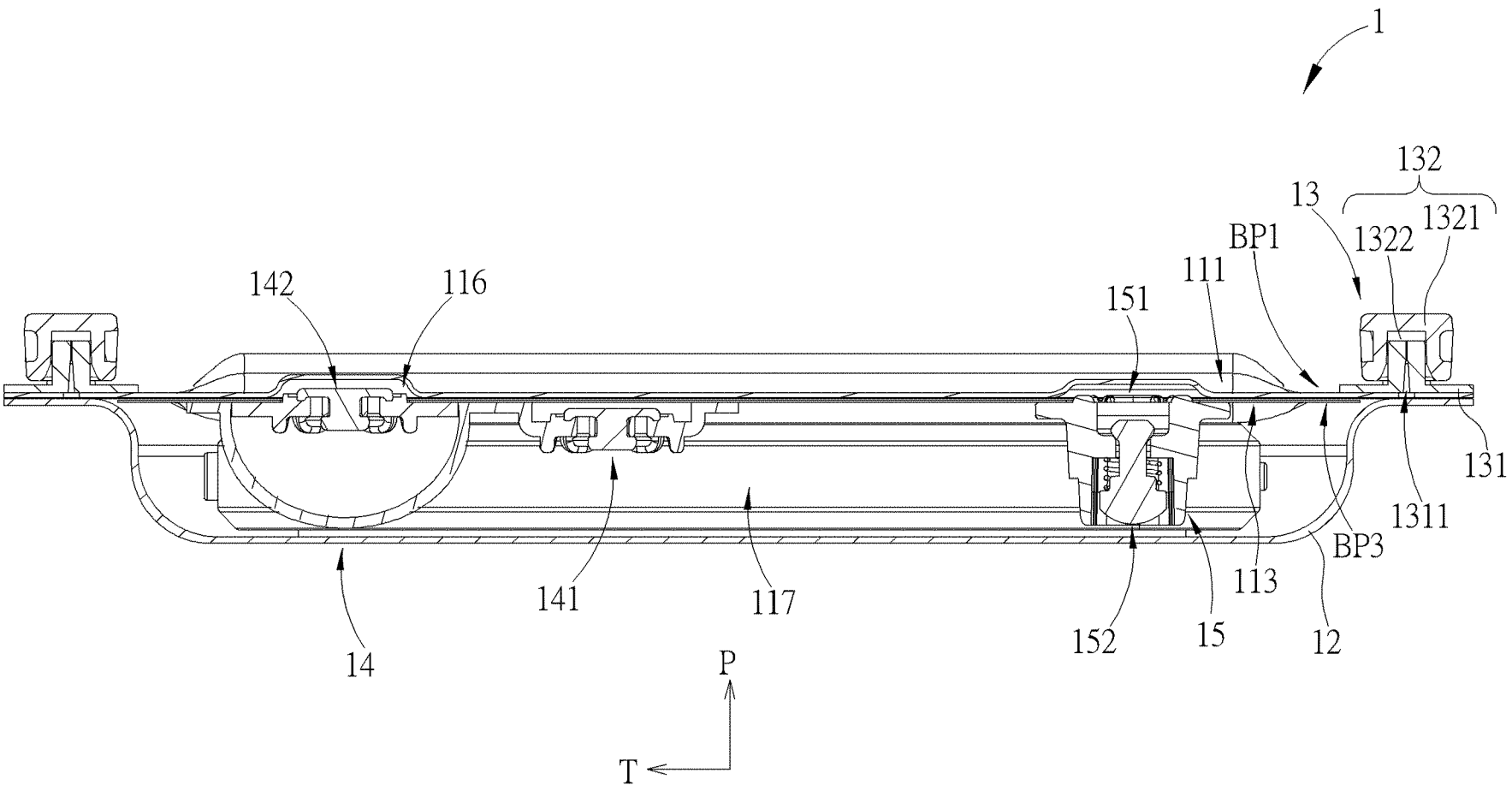
FIG. 4 is a sectional diagram of the waterproof container along a traverse direction according to the first embodiment of the present invention.

Please refer to FIG. 1 to FIG. 4. FIG. 1 is a schematic diagram of a waterproof container 1 according to a first embodiment of the present invention. FIG. 2 is an exploded diagram of the waterproof container 1 according to the first embodiment of the present invention. FIG. 3 is a sectional diagram of the waterproof container 1 along a longitudinal direction L according to the first embodiment of the present invention. FIG. 4 is a sectional diagram of the waterproof container 1 along a traverse direction T according to the first embodiment of the present invention. As shown in FIG. 1 to FIG. 4, the waterproof container 1 is adapted for an electronic device 2 with a touch screen 21. In this embodiment, the electronic device 2 can be a mobile phone with a capacitive touch screen, and the waterproof container 1 can be a waterproof bag. However, the present invention is not limited thereto. For example, in another embodiment, the electronic device can be a tablet computer with a capacitive touch screen, and the waterproof container can be a waterproof case.

As shown in FIG. 1 to FIG. 4, the waterproof container 1 includes an upper component 11 and a lower component 12. The upper component 11 includes a first layer 111, a second layer 112 and a third layer 113. The first layer 111 includes a first touched part TP1 corresponding to the touch screen 21 of the electronic device 2. The second layer 112 includes a second touched part TP2 corresponding to the touch screen 21 of the electronic device 2 and the first touched part TP1 of the first layer 111. The third layer 113 includes a third touched part TP3 corresponding to the touch screen 21 of the electronic device 2, the first touched part TP1 of the first layer 111 and the second touched part TP2 of the second layer 112. The second touched part TP2 of the second layer 112 is disposed between the first touched part TP1 of the first layer 111 and the third touched part TP3 of the third layer 113. The second touched part TP2 of the second layer 112 is connected to the first touched part TP1 of the first layer 111 by a plurality of first connections 114. The second touched part TP2 of the second layer 112 is connected to the third touched part TP3 of the third layer 113 by a plurality of second connections 115. The plurality of first connections 114 and the plurality of second connections 115 are staggered relative to each other. An enclosing space 116 is enclosed by the first layer 111 and the third layer 113 of the upper component 11 for accommodating fluid, which can preferably be air. The lower component 12 is connected to the upper component 11. An accommodating space 117 is enclosed by the lower component 12 and the upper component 11 for accommodating the electronic device 2. When the electronic device 2 is accommodated inside the accommodating space 117, the touch screen 21 and a rear cover 22 of the electronic device 2 is adjacent to the upper component 11 and the lower component 12, respectively. When the waterproof container 1 and the electronic device 2 accommodated inside the accommodating space 117 are immersed into water, the upper component 11 can effectively keep the water away from the touch screen 21 of the electronic device 2, so that the present invention can prevent interference of touch operation of the touch screen 21 from the water.

Specifically, each of the first touched part TP1 of the first layer 111, the second touched part TP2 of the second layer 112 and the third touched part TP3 of the third layer 113 can be formed in a wave-shaped structure. The plurality of first connections 114 and the plurality of second connections 115 are staggered relative to each other along the longitudinal direction L of the upper component 11 and are line-shaped connections extending along the traverse direction T of the upper component 11 perpendicular to the longitudinal direction L of the upper component 11.

However, the present invention is not limited to this embodiment. For example, in another embodiment, the first touched part of the first layer and the third touched part of the third layer can be two flat structures parallel to each other, and the second touched part of the second layer can be a wave-shaped structure sandwiched between and connected to the first touched part of the first layer and the third touched part of the third layer. Furthermore, the plurality of first connections and the plurality of second connections can be line-shaped connections extending along the longitudinal direction of the upper component and staggered relative to each other along the traverse direction.

Preferably, the first touched part TP1 of the first layer 111 is separated from the third touched part TP3 of the third layer 113 by the second touched part TP2 of the second layer 112 and can be spaced from the third touched part TP3 of the third layer 113 at a uniform distance D. However, the present invention is not limited to this embodiment. For example, in another embodiment, the first touched part of the first layer can be separated from the third touched part of the third layer at varied distances.

Furthermore, preferably, the second layer 112 is configured to divide the enclosing space 116 into a first enclosing space 118 enclosed by the first layer 111 and the second layer 112 and a second enclosing space 119 enclosed by the second layer 112 and the third layer 113 and communicated with the first enclosing space 118. However, the present invention is not limited to this embodiment. For example, in another embodiment, the first enclosing space can be isolated from the second enclosing space by the second layer.

Besides, in this embodiment, the lower component 12 is connected to the first layer 111 of the upper component 11, and the accommodating space 117 is enclosed by the lower component 12 and the third layer 113 of the upper component 11. Specifically, as shown in FIG. 2 to FIG. 4, the lower component 12 can be a flat film made of plastic material, such as polypropylene (PP), polyethylene (PE), polyvinylchloride, or Thermoplastic polyurethanes (TPU), or silicon, and the first layer 111 further includes a first border part BP1 outwardly extending from the first touched part TP1. The third layer 113 further includes a third border part BP3 outwardly extending from the third touched part TP3. Each of the first border part BP1 of the first layer 111 and the third border part BP3 of the third layer 114 can be formed in a flat structure. The third border part BP3 of the third layer 113 is connected to the first border part BP1 of the first layer 111. A portion of the first border part BP1 of the first layer 111 protruding from the third border part BP3 of the third layer 113 is connected to the lower component 12.

However, the present invention is not limited to this embodiment. For example, in another embodiment, each of the first border part and the third border part can be formed in a wave-shaped structure, and the lower component can be connected to the third layer.

In addition, as shown in FIG. 1 to FIG. 4, in this embodiment, the waterproof container 1 further includes a sealable opening structure 13 disposed on the upper component 11 for providing access to the accommodating space 117.

Specifically, the sealable opening structure 13 includes an elastomeric protruding component 131 and a covering assembly 132. The elastomeric protruding component 131 is disposed on a top side of the first border part BP1 of the first layer 111 of the upper component 11 and protrudes from the first layer 111 of the upper component 11 in a protruding direction P which is parallel to a normal direction of the first layer 111 of the upper component 11. A slit 1311 penetrates through the elastomeric protruding component 131 along the protruding direction P and is communicated with the accommodating space 117 for allowing the electronic device 2 to enter into the accommodating space 117 from outside of the waterproof container 1. The covering assembly 132 includes a covering component 1321 and a sealing component 1322. The covering component 1321 is pivotally connected to the elastomeric protruding component 131. The covering component 1321 is for squeezing the elastomeric protruding component 131 along a direction perpendicular to the protruding direction P, e.g., the traverse direction T and/or the longitudinal direction L, when the covering assembly 132 is engaged with the elastomeric protruding component 131. The sealing component 1322 is disposed on the covering component 1321 and made of elastomeric material. The sealing component 1322 is for squeezing the elastomeric protruding component 131 along the protruding direction P when the covering assembly 132 is engaged with the elastomeric protruding component 131. The slit 1311 can be sealed properly when the covering assembly 132 is pivoted to engage with the elastomeric protruding component 131 by the engaging component 1321 and the sealing component 1322. The electronic device 2 can be placed into the accommodating space 117 via the slit 1311 when the covering assembly 132 is pivoted to disengage from the elastomeric protruding component 131. The structure and the operation of the sealable opening structure 13 of the waterproof container 1 of this embodiment of the present invention are similar to the ones of the sealing system of U.S. patent application Ser. No. 16/835,327. Detailed description is omitted herein for simplicity. Preferably, each of the elastomeric protruding component 131, the covering component 1321 and the sealing component 1322 is formed in a U-shaped structure.

However, the present invention is not limited to this embodiment. For example, in another embodiment, the sealing component can be omitted. Alternatively, in another embodiment, each of the elastomeric protruding component and the covering assembly can be formed in a straight structure, and the covering assembly can be detachable from the elastomeric protruding component in a sliding manner or in a snapping manner. Alternatively, in another embodiment, the sealable opening structure can be disposed on the lower component. Alternatively, in another embodiment, the sealable opening structure can include an opening formed between the lower component and the upper component, and a zipper assembly for sealing the opening.

As shown in FIG. 3, when it is desired to operate the electronic device 2 underwater, a user can use his/her finger to collapse a touched portion of the upper component 11 by pressing a corresponding portion of the first touched part TP1 of the first layer 111, a corresponding portion of the second touched part TP2 of the second layer 112 and a corresponding portion of the third touched part TP3 of the third layer 113. When the touched portion of the upper component 11 is collapsed by pressing the corresponding portion of the first touched part TP1 of the first layer 111, the corresponding portion of the second touched part TP2 of the second layer 112 and the corresponding portion of the third touched part TP3 of the third layer 113 with the user's finger, due to a staggered arrangement of the plurality of first connections 114 and the plurality of second connections 115, other portions of the first touched part TP1 of the first layer 111, other portions of the second touched part TP2 of the second layer 112 and other portions of the third touched part TP3 of the third layer 113 can remain their original shapes and not be deformed, so that an untouched portion of the upper component 11 is not collapsed. Furthermore, when the fluid is forced by the user's finger to flow inside the enclosing space 116, the plurality of first connections 114 and the plurality of second connections 115 can prevent excessive inflation and excessive deflation of the untouched portion of the upper component 11, so as to prevent abnormal excessive accumulation and loss of the fluid to prevent collapse of the untouched portion of the upper component 11 caused by the abnormal accumulation and loss of the fluid. Therefore, a first portion of the touch screen 21 corresponding to the touch portion of the upper component 11 is close to the user's finger, and a second portion of the touch screen 21 corresponding to the untouched portion of the upper component 11 is still away from the water, which prevents a desired touch operation of the first portion of the touch screen 21 from being interfered by an unintentional touch operation of the second portion of the touch screen 21 caused by the water. Furthermore, when the user removes his/her finger, the touched portion of the upper component 11 can be recovered by cooperation of recovery of the first layer 111, the second layer 112 and the third layer 113 and recovery of the compressed fluid inside the enclosing space 116.

Moreover, as shown in FIG. 2 to FIG. 4, in this embodiment, in order to prevent the untouched portion of the upper component 11 from being collapsed by the water with high pressure, the waterproof container 1 further includes an inflating pump 14 and a relief valve 15. The inflating pump 14 is for inflating the enclosing space 116 enclosed by the first layer 111 and the third layer 113 with the fluid, e.g., the air, by allowing the fluid to flow into the enclosing space 116 enclosed by the first layer 111 and the third layer 113. The relief valve 15 is for deflating the enclosing space 116 enclosed by the first layer 111 and the third layer 113 by allowing the fluid to flow out of the enclosing space 116 enclosed by the first layer 111 and the third layer 113.

Specifically, the inflating pump 14 is for inflating the enclosing space 116 by allowing the fluid to flow from the accommodating space 117 to the enclosing space 116, and the relief valve 15 is for deflating the enclosing space 116 by allowing the fluid to flow from the enclosing space 116 to the accommodating space 117. In other words, a suction 141 and a discharge 142 of the inflating pump 14 are respectively configured to be communicated with the accommodating space 117 and the enclosing space 116, and a suction 151 and a discharge 152 of the relief valve 15 are respectively configured to be communicated with the enclosing space 116 and the accommodating space 117. When it is desired to use the waterproof container 1 under a higher water pressure condition, e.g., deep diving, the user can inflate the enclosing space 116 with the fluid to increase a pressure inside the enclosing space 116 by operating the inflating pump 14 to allow the fluid to flow from the accommodating space 117 to the enclosing space 116. When the pressure inside the enclosing space 116 is increased, it is required for the user to apply a greater force to collapse the touched portion of the upper component 11. Therefore, it can effectively prevent the untouched portion of the upper component 11 from being collapsed by the water even under the higher water pressure condition. On the other hand, when it is desired to use the waterproof container 1 under a lower water pressure condition, e.g., swimming, the user can deflate the enclosing space 116 by operating the relief valve 15 to allow the fluid to flow from the enclosing space 116 to the accommodating space 117. When the pressure inside the enclosing space 116 is decreased, it only needs to apply a small force to collapse the touched portion of the upper component 11, so as to achieve easy operation.

However, the present invention is not limited to this embodiment. For example, in another embodiment, the inflating pump and the relief valve can be omitted. Furthermore, the types or the structures of the inflating pump and the relief valve are not limited to those illustrated in the figures of this embodiment.

Figure 5:
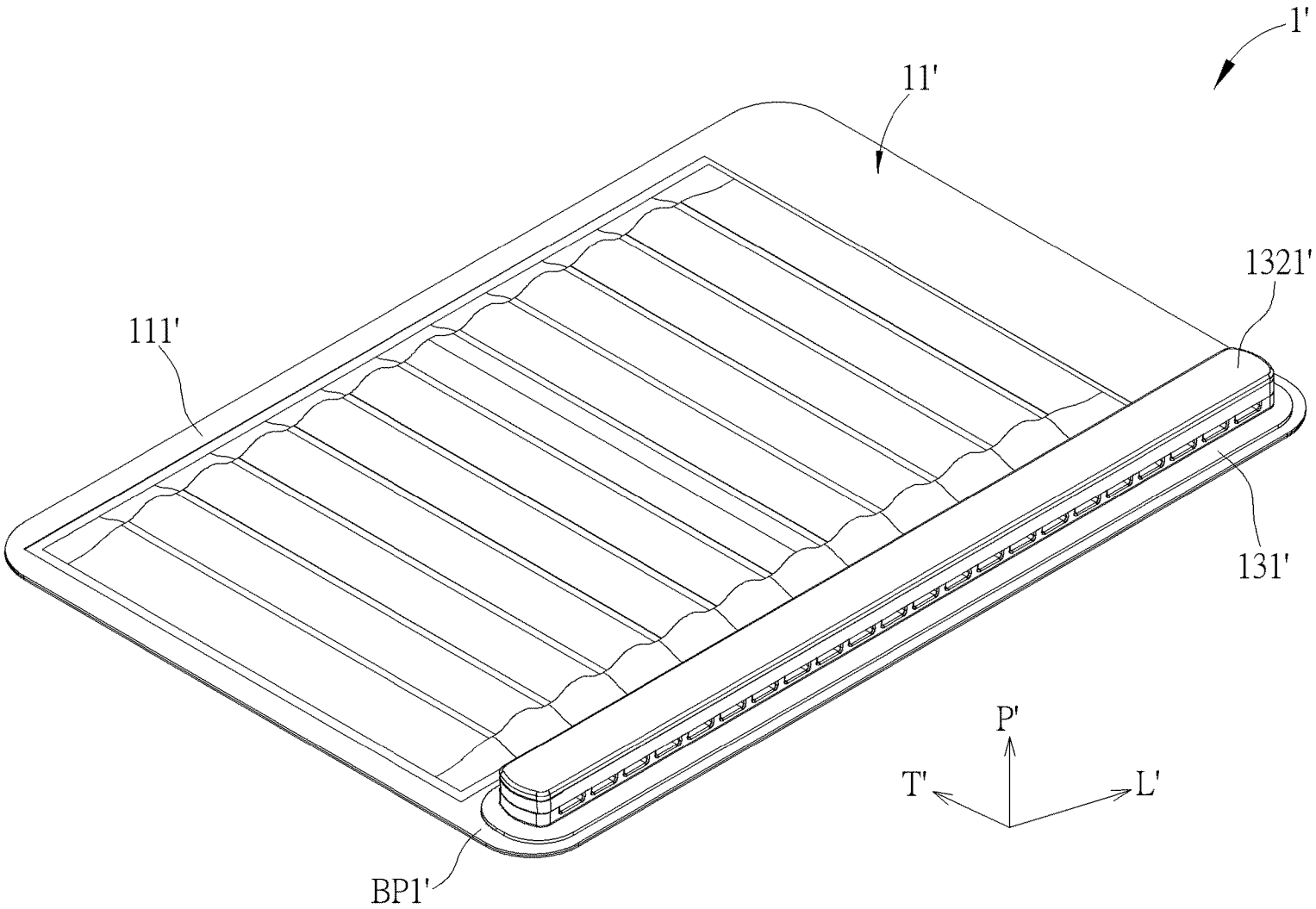
FIG. 5 is a schematic diagram of a waterproof container according to a second embodiment of the present invention.
Figure 6:
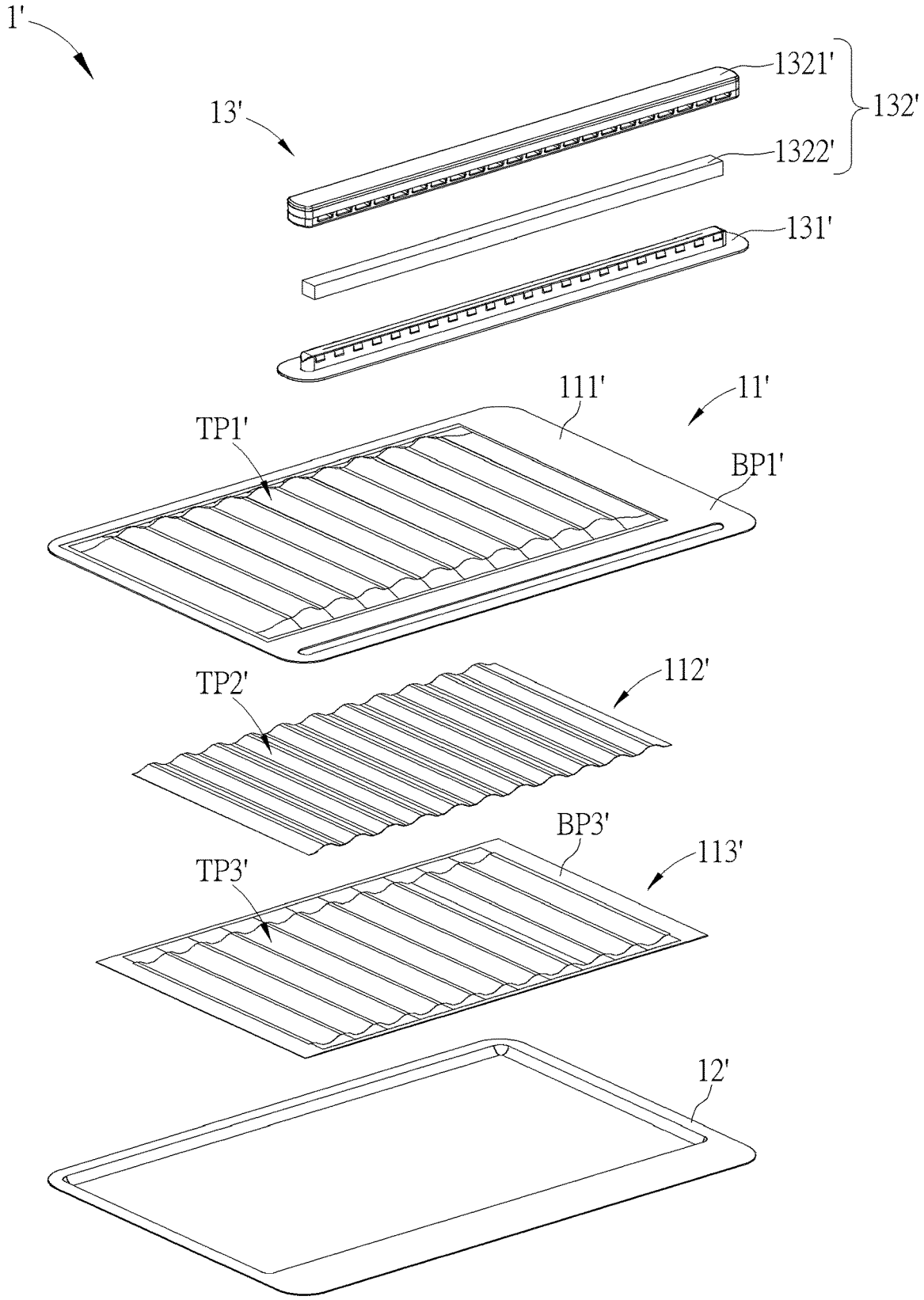
FIG. 6 is an exploded diagram of the waterproof container according to the second embodiment of the present invention.
Figure 7:
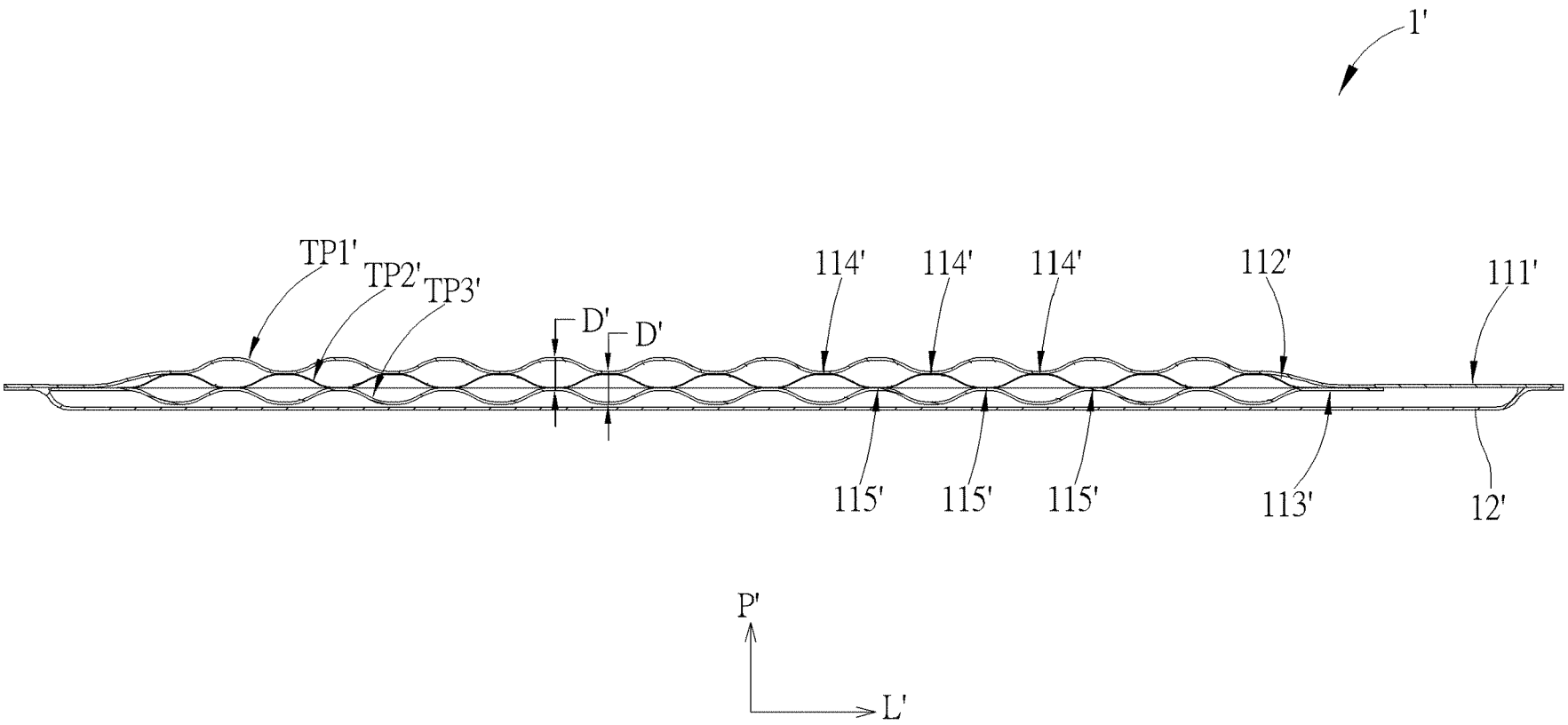
FIG. 7 is a sectional diagram of the waterproof container along a longitudinal direction according to the second embodiment of the present invention.
Figure 8:
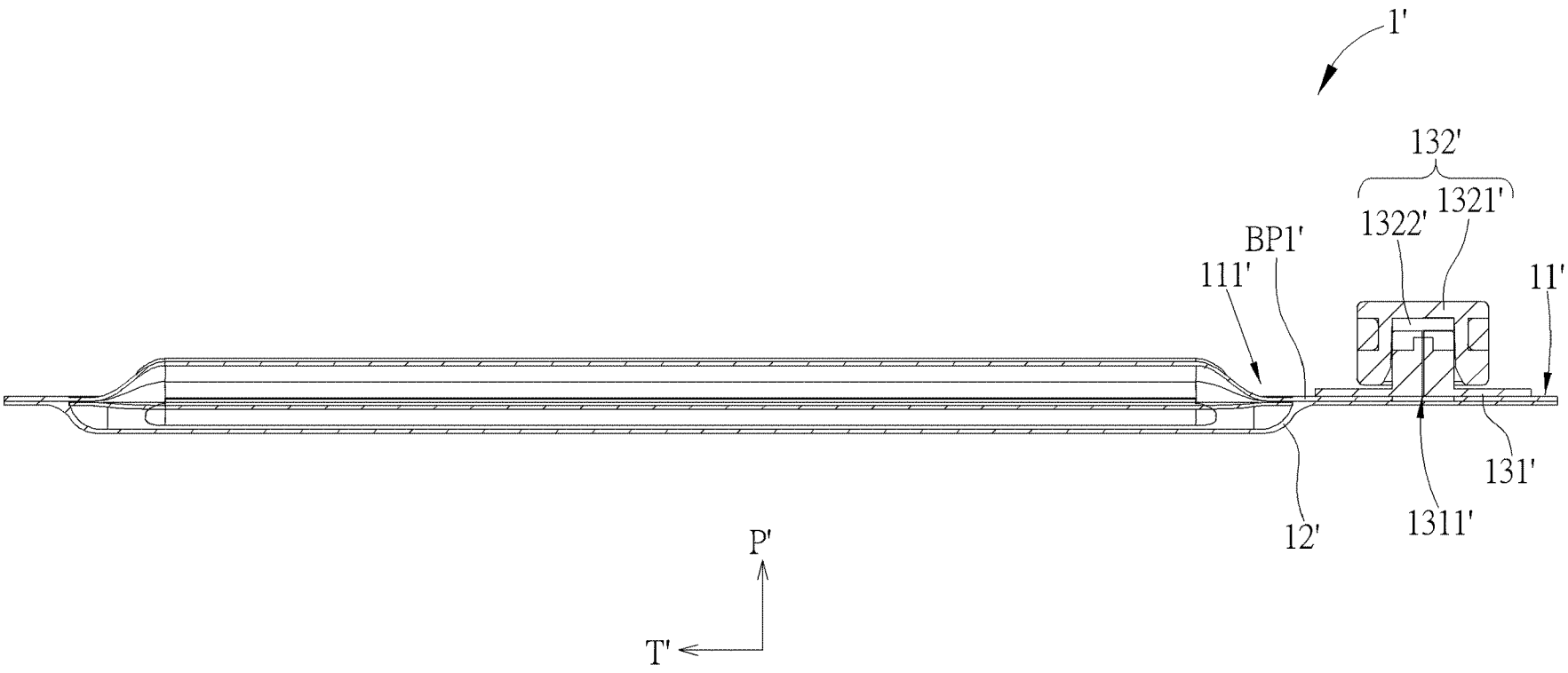
FIG. 8 is a sectional diagram of the waterproof container along a traverse direction according to the second embodiment of the present invention.

Please refer to FIG. 5 to FIG. 8. FIG. 5 is a schematic diagram of a waterproof container 1' according to a second embodiment of the present invention. FIG. 6 is an exploded diagram of the waterproof container 1' according to the second embodiment of the present invention. FIG. 7 is a sectional diagram of the waterproof container 1' along a longitudinal direction L' according to the second embodiment of the present invention. FIG. 8 is a sectional diagram of the waterproof container 1' along a traverse direction T' according to the second embodiment of the present invention. As shown in FIG. 5 to FIG. 8, different from the first embodiment, in this embodiment, the inflating pump 14 and the relief valve 15 of the first embodiment are omitted. Furthermore, in this embodiment, an elastomeric protruding component 131' is disposed on a lateral side of a first border part BP1' of a first layer 111' of an upper component 11', and a covering assembly 132' is configured to engage with the elastomeric protruding component 131' by snapping. Besides, each of the elastomeric protruding component 131' and the covering assembly 132' is formed in a straight structure extending along the longitudinal direction L' of the upper component 11', and a covering component 1321' and a sealing component 1322' of the covering assembly 132' are for squeezing the elastomeric protruding component 131' along the traverse direction T' and a protruding direction P' respectively. Other structures of the waterproof container 1' of this embodiment are similar to the ones of the waterproof container 1 of the first embodiment. Detailed description is omitted herein for simplicity.

Figure 9:
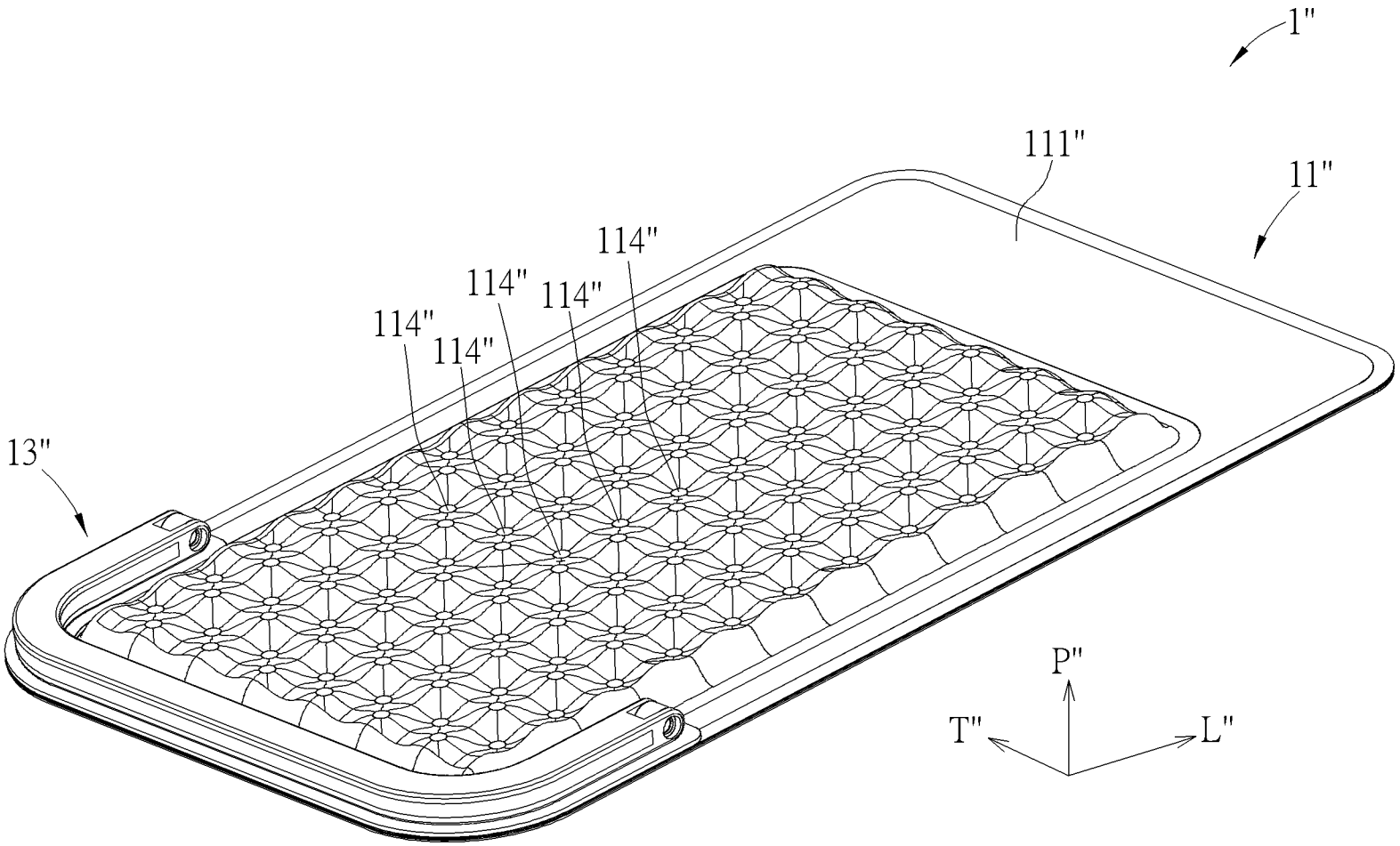
FIG. 9 is a schematic diagram of a waterproof container according to a third embodiment of the present invention.
Figure 10:
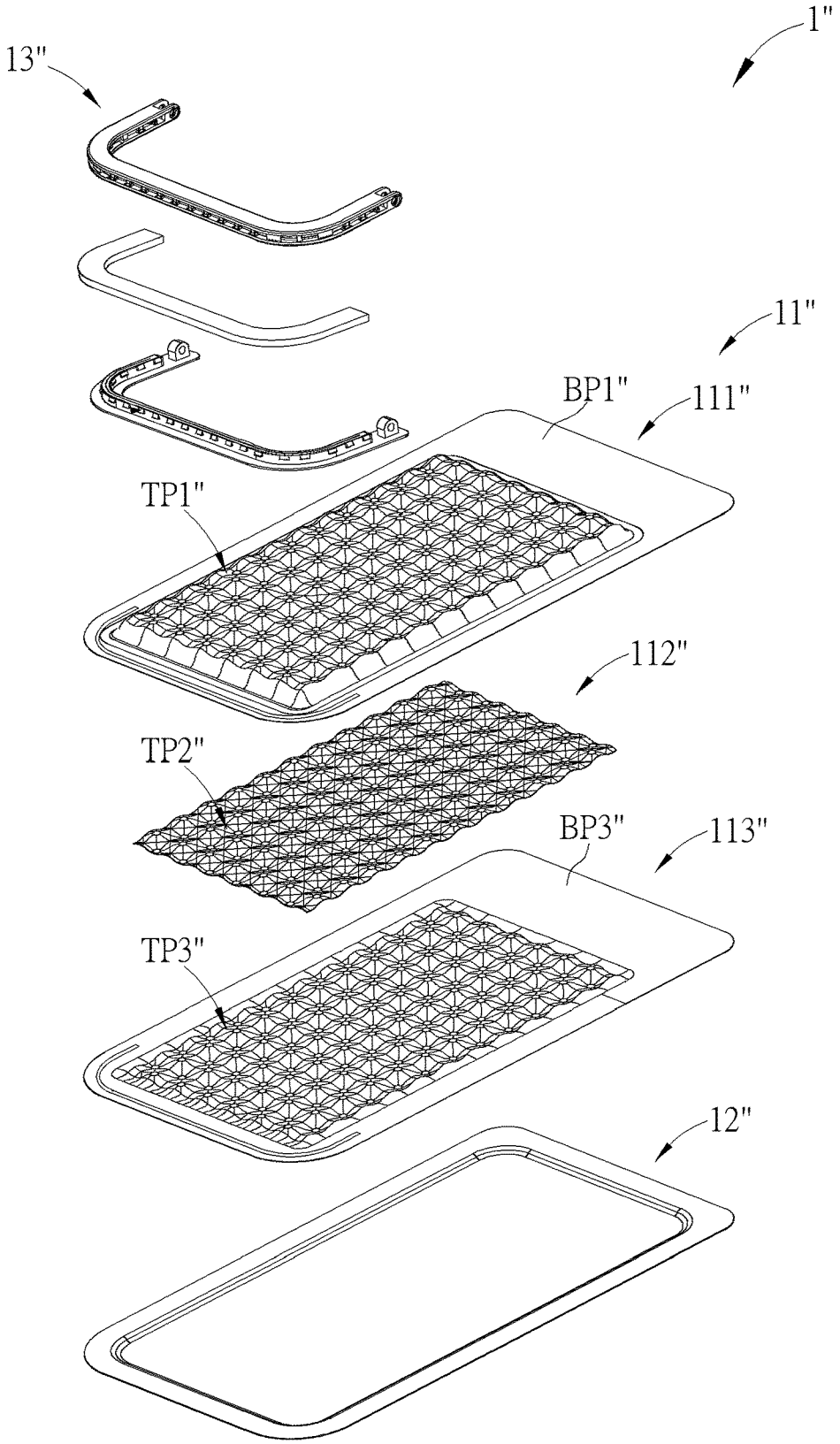
FIG. 10 is an exploded diagram of the waterproof container according to the third embodiment of the present invention.
Figure 11:
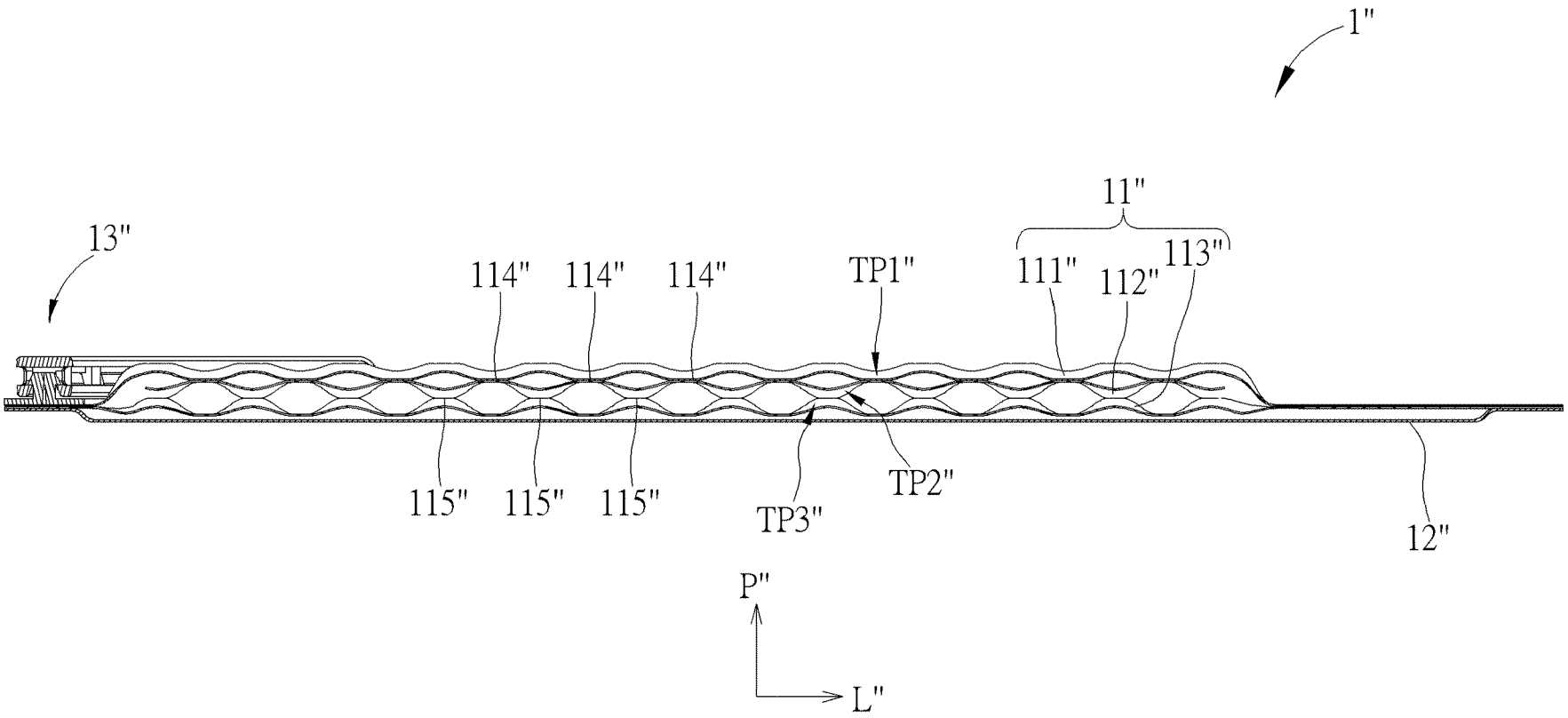
FIG. 11 is a sectional diagram of the waterproof container along a longitudinal direction according to the third embodiment of the present invention.
Figure 12:
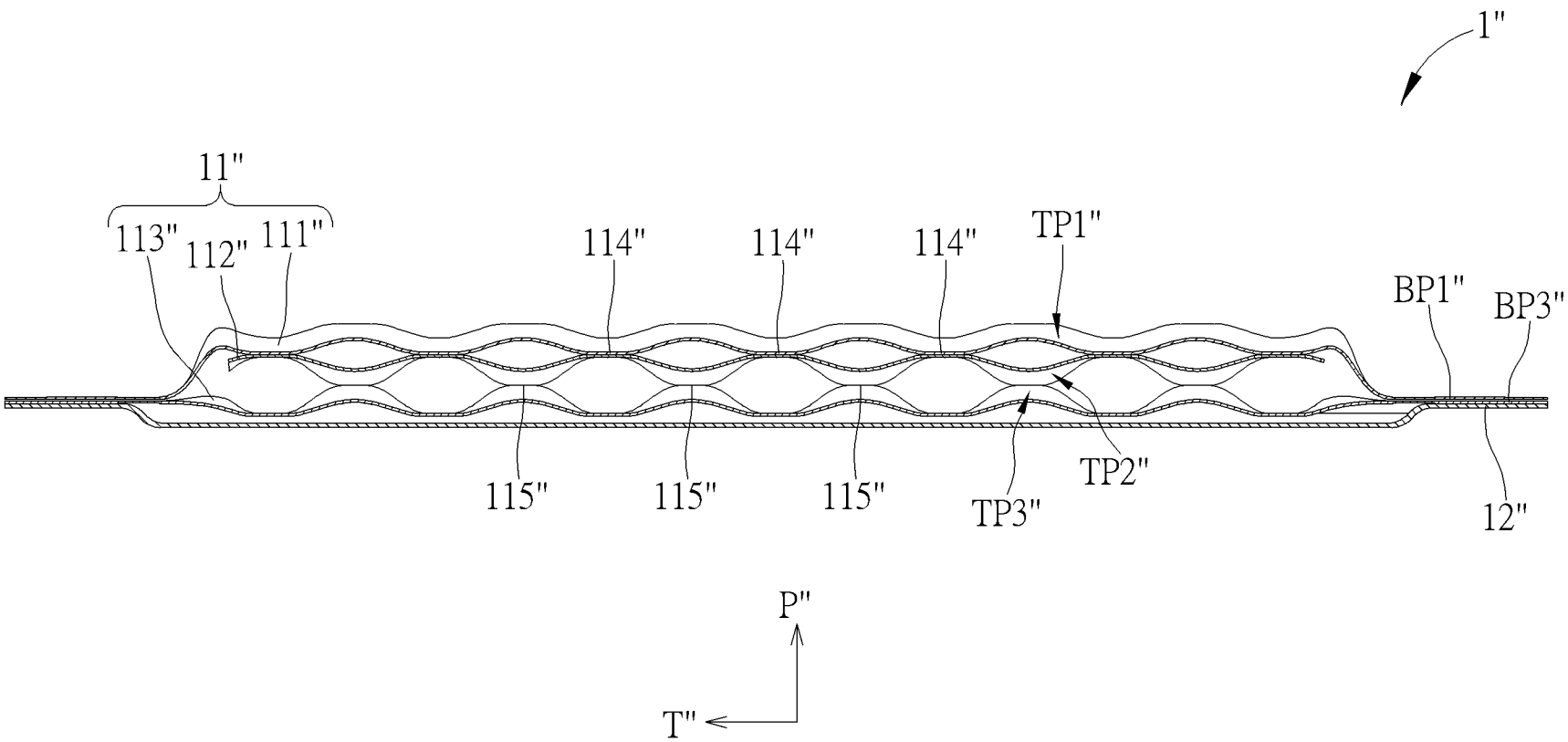
FIG. 12 is a sectional diagram of the waterproof container along a traverse direction according to the third embodiment of the present invention.

Please refer to FIG. 9 to FIG. 12. FIG. 9 is a schematic diagram of a waterproof container 1" according to a third embodiment of the present invention. FIG. 10 is an exploded diagram of the waterproof container 1" according to the third embodiment of the present invention. FIG. 11 is a sectional diagram of the waterproof container 1" along a longitudinal direction L" according to the third embodiment of the present invention. FIG. 12 is a sectional diagram of the waterproof container 1" along a traverse direction T" according to the third embodiment of the present invention. As shown in FIG. 9 to FIG. 12, different from the first embodiment, in this embodiment, the inflating pump 14 and the relief valve 15 of the first embodiment are omitted. Furthermore, in this embodiment, a plurality of first connections 114" and a plurality of second connections 115" are staggered relative to each other along the longitudinal direction L" and the traverse direction T" of an upper component 11" and are dot-shaped connections for preventing the untouched portion of the upper component 11" from being collapsed. Furthermore, a lower component 12" is connected to a third border part BP3" of the third layer 113" of the upper component 11". Other structures of the waterproof container 1" of this embodiment are similar to the ones of the waterproof container 1 of the first embodiment. Detailed description is omitted herein for simplicity.

Figure 13:
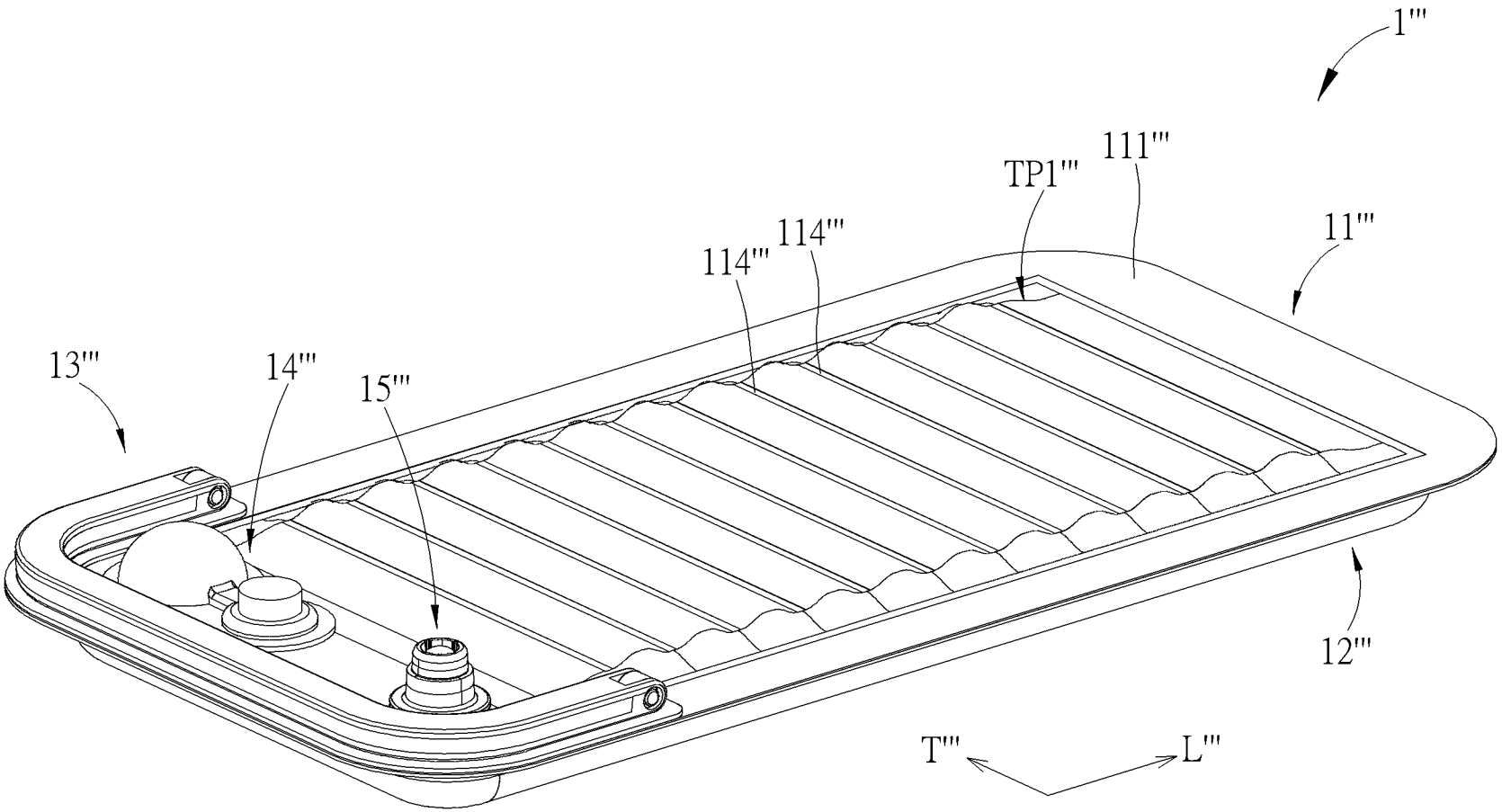
FIG. 13 is a schematic diagram of a waterproof container according to a fourth embodiment of the present invention.
Figure 14:
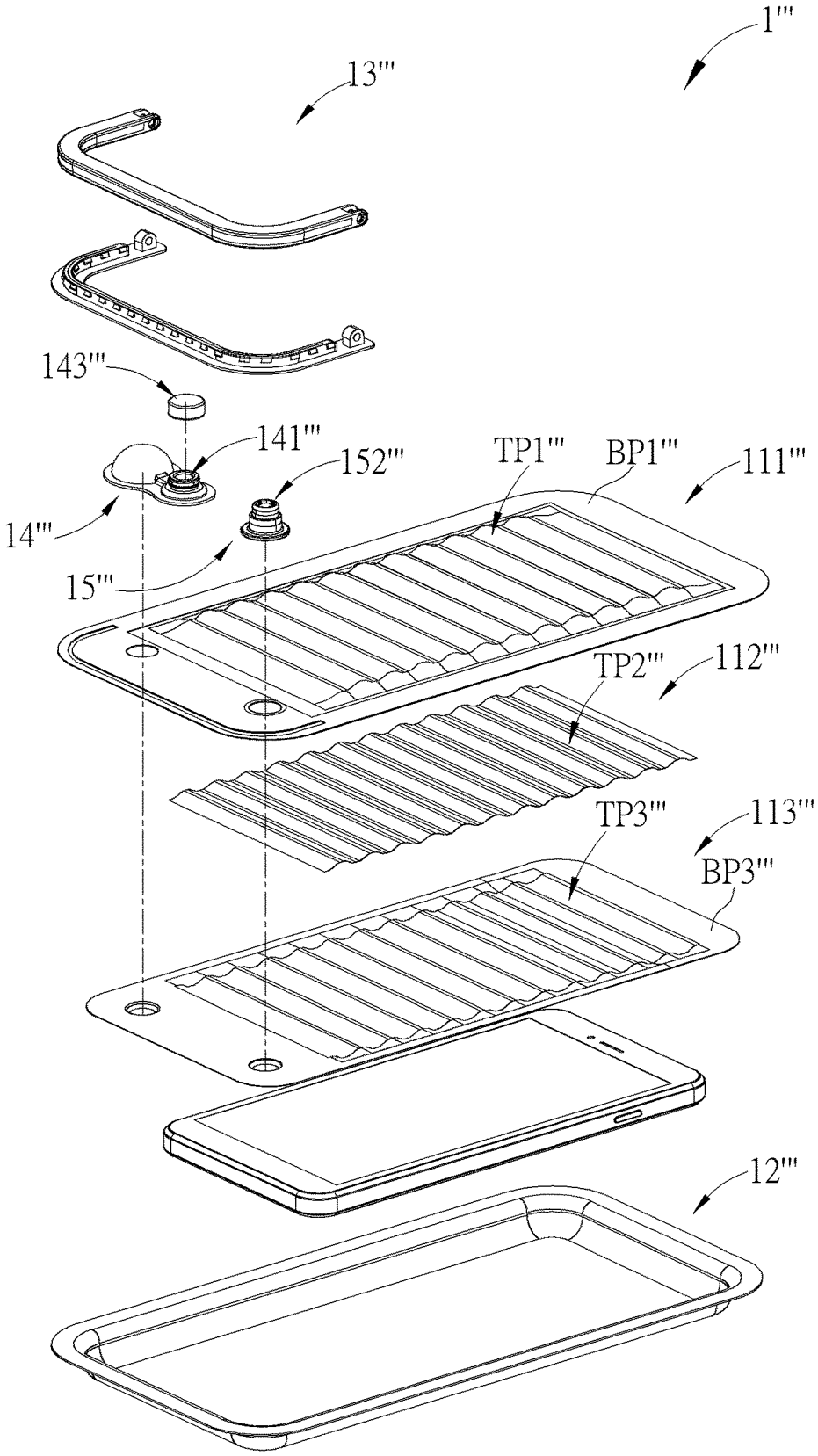
FIG. 14 is an exploded diagram of the waterproof container according to the fourth embodiment of the present invention.
Figure 15:
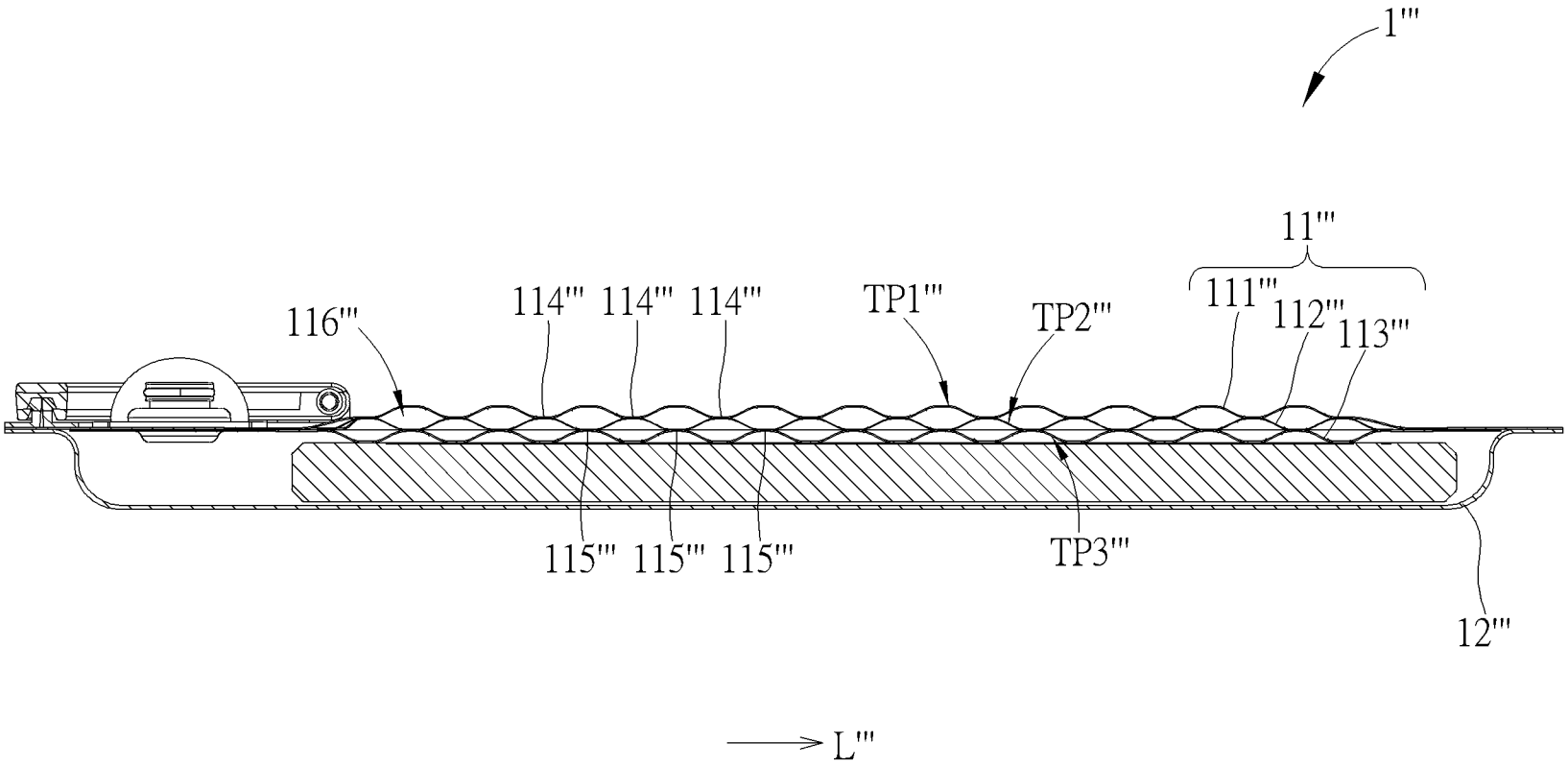
FIG. 15 is a sectional diagram of the waterproof container along a longitudinal direction according to the fourth embodiment of the present invention.
Figure 16:
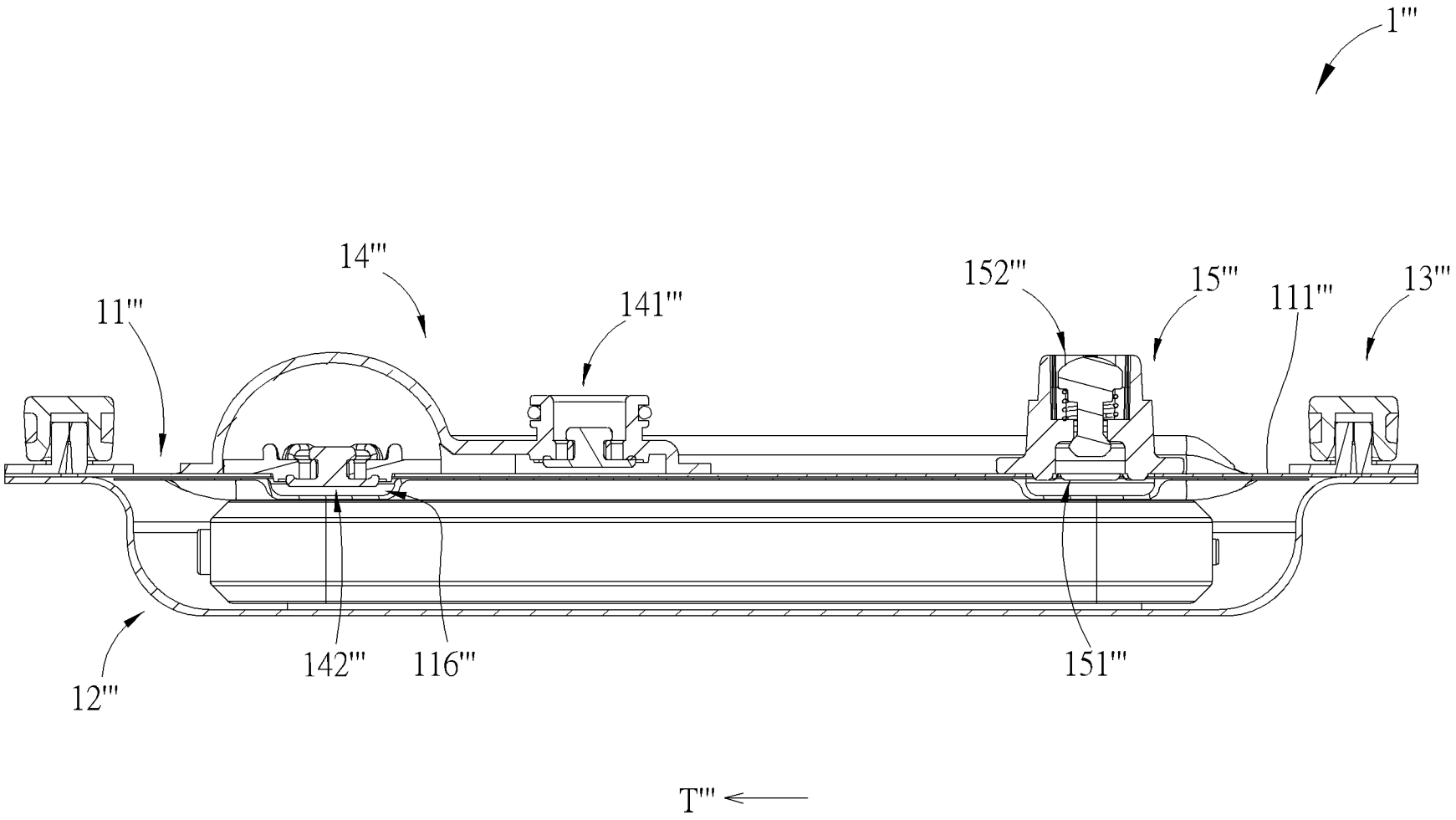
FIG. 16 is a sectional diagram of the waterproof container along a traverse direction according to the fourth embodiment of the present invention.

Please refer to FIG. 13 to FIG. 16. FIG. 13 is a schematic diagram of a waterproof container 1''' according to a fourth embodiment of the present invention. FIG. 14 is an exploded diagram of the waterproof container 1''' according to the fourth embodiment of the present invention. FIG. 15 is a sectional diagram of the waterproof container 1''' along a longitudinal direction L''' according to the fourth embodiment of the present invention. FIG. 16 is a sectional diagram of the waterproof container 1''' along a traverse direction T''' according to the fourth embodiment of the present invention. As shown in FIG. 13 to FIG. 16, different from the first embodiment, in this embodiment, a inflating pump 14''' is for inflating the enclosing space 116''' enclosed by the first layer 111''' and the third layer 113''' with the fluid by allowing the fluid to flow from an environment outside the waterproof container 1''' to the enclosing space 116''' enclosed by the first layer 111''' and the third layer 113''', and a relief valve 15''' is for deflating the enclosing space 116''' enclosed by the first layer 111''' and the third layer 113''' by allowing the fluid to flow from the enclosing space 116''' enclosed by the first layer 111''' and the third layer 113''' to the environment outside the waterproof container 1'''. In other words, a suction 141''' and a discharge 142''' of the inflating pump 14''' are respectively configured to be communicated with the environment and the enclosing space 116''', and a suction 151''' and a discharge 152''' of the relief valve 15''' are respectively configured to be communicated with the enclosing space 116''' and the environment. The aforementioned configuration allows the user to adjust a maximum bearable pressure of the upper component 11''' by inflating or deflating the enclosing space 116''' with environmental air before immersing the waterproof container 1''' in water. Furthermore, the inflating pump 14''' further includes a cap 143''' to cover the suction 141''' for preventing environmental water from flowing into the enclosing space 116''' after immersing the waterproof container 1''' in water. Other structures of the waterproof container 1''' of this embodiment are similar to the ones of the waterproof container 1 of the first embodiment. Detailed description is omitted herein for simplicity.

Figure 17:
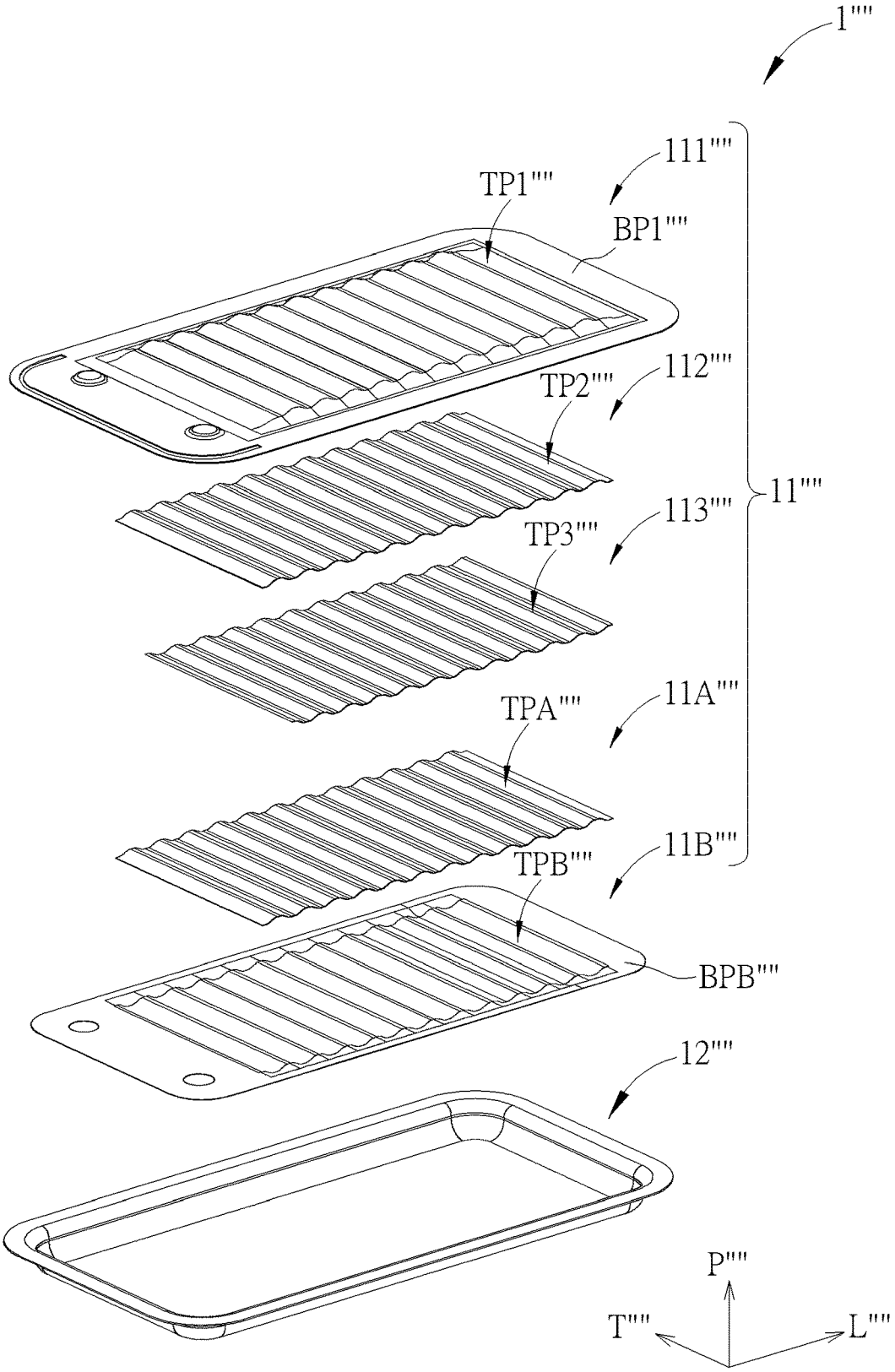
FIG. 17 is a partial exploded diagram of a waterproof container according to a fifth embodiment of the present invention.
Figure 18:
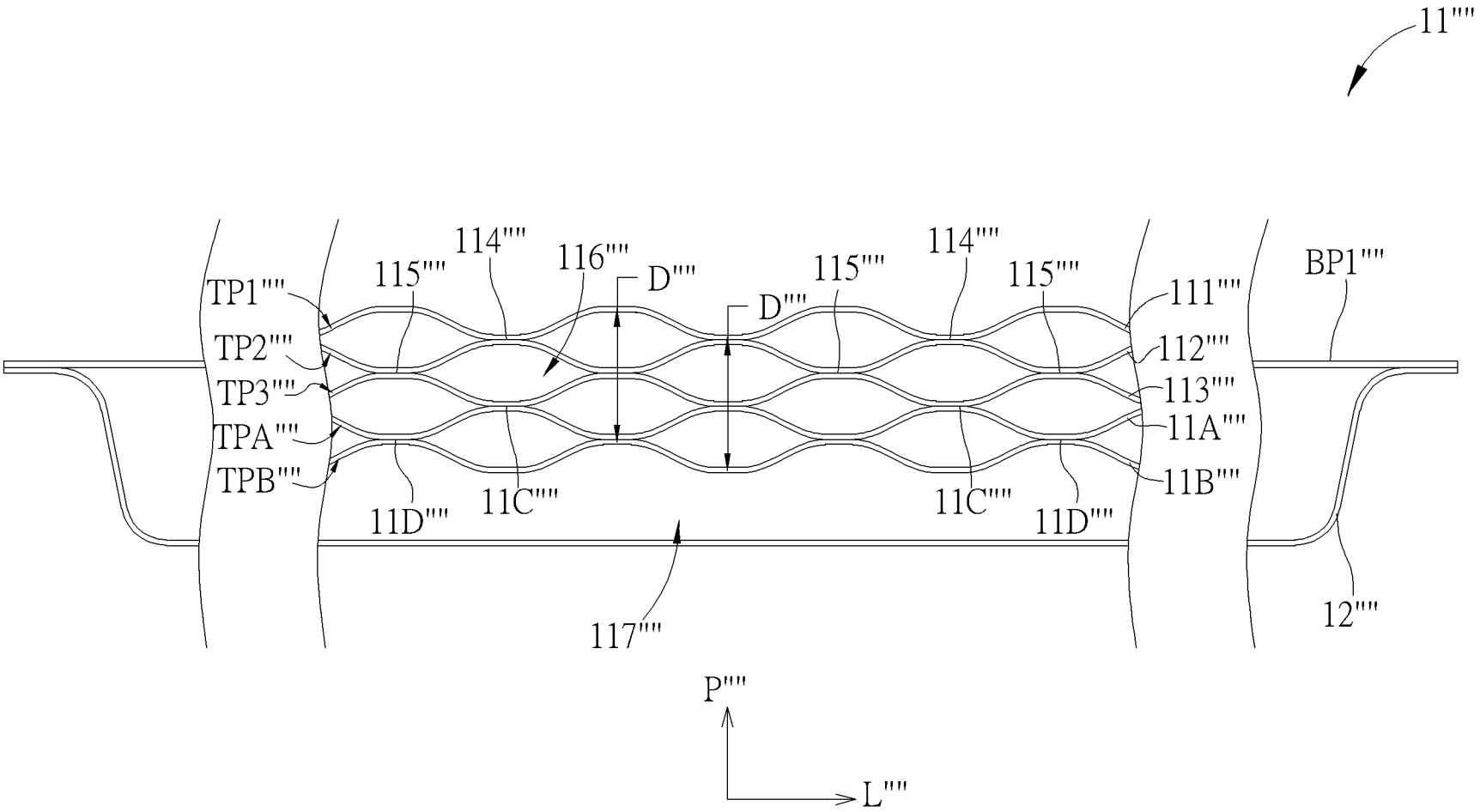
FIG. 18 is a partial sectional diagram of the waterproof container according to the fifth embodiment of the present invention.

Furthermore, in another embodiment, the upper component even can include more than three layers. For example, please refer to FIG. 17 and FIG. 18. FIG. 17 is a partial exploded diagram of a waterproof container 1'''' according to a fifth embodiment of the present invention. FIG. 18 is a partial sectional diagram of the waterproof container 1'''' according to the fifth embodiment of the present invention. As shown in FIG. 17 and FIG. 18, different from the aforementioned embodiments, in this embodiment, an upper component 11'''' includes a first layer 111'''', a second layer 112'''', a third layer 113'''', a fourth layer 11A'''' and a fifth layer 11B''''. The first layer 111'''' includes a first touched part TP1'''' and a first border part BP1''''. The second layer 112'''' includes a second touched part TP2''''. The third layer 113'''' includes a third touched part TP3''''. The fourth layer 11A'''' includes a fourth touched part TPA''''. The fifth layer 11B'''' includes a fifth touched part TPB'''' and a fifth border part BPB''''. Each of the first touched part TP1'''', the second touched part TP2'''', the third touched part TP3'''', the fourth touched part TPA'''' and the fifth touched part TPB'''' is formed in a wave-shaped structure. Each of the first border part BPI'''' and the fifth border part BPB'''' is formed in a flat structure. The first border part BP1'''' and the fifth border part BPB'''' are connected to each other. A lower component 12'''' is connected to the first border part BPI''''. The first touched part TP1'''', the third touched part TP3'''' and the fifth touched part TPB'''' are parallel to each other. The second touched part TP2'''' and the fourth touched part TPA'''' are parallel to each other. The second touched part TP2'''' is connected to the first touched part TP1'''' by a plurality of first connections 114''''. The second touched part TP2'''' is connected to the third touched part TP3'''' by a plurality of second connections 115''''. The fourth touched part TPA'''' is connected to the third touched part TP3'''' by a plurality of third connections 11C''''. The fifth touched part TPB'''' is connected to the fourth touched part TPA'''' by a plurality of fourth connections 11D''''. The plurality of first connections 114'''', the plurality of second connections 115'''', the plurality of third connections 11C'''' and the plurality of fourth connections 11D'''' are line-shaped connections extending along a traverse direction T'''' of the upper component 11''''. The plurality of first connections 114'''' and the plurality of second connections 115'''' are staggered relative to each other along a longitudinal direction L'''' of the upper component 11''''. The plurality of second connections 115'''' and the plurality of third connections 11C'''' are staggered relative to each other along the longitudinal direction L'''' of the upper component 11''''. The plurality of third connections 11C'''' and the plurality of fourth connections 11D'''' are staggered relative to each other along the longitudinal direction L'''' of the upper component 11''''. In other words, an enclosing space 116'''' is enclosed by the first layer 111'''' and the fifth layer 11B'''', and an accommodating space 117'''' is enclosed by the lower component 12'''' and the fifth layer 11B''''.

Preferably, the plurality of third connections 11C'''' are respectively aligned with the plurality of first connections 114'''' along a protruding direction P'''', and the plurality of fourth connections 11D'''' are respectively aligned with the plurality of second connections 115'''' along the protruding direction P''''. Preferably, the first touched part TP1'''' is spaced from the fifth touched part TPB'''' at a uniform distance D''''.

However, there can be more various embodiments. For example, in another embodiment, the plurality of first connections, the plurality of second connection, the plurality of third connections and the plurality of fourth connections can be staggered relative to one another along the longitudinal direction of the upper component. Alternatively, in another embodiment, the plurality of first connections, the plurality of second connections, the plurality of third connections and the plurality of fourth connections can be line-shaped connections extending along the longitudinal direction of the upper component and staggered relative to one another along the traverse direction. Alternatively, in another embodiment, the plurality of first connections, the plurality of second connections, the plurality of third connections and the plurality of fourth connections can be dot-shaped connections staggered relative to one another along the longitudinal direction, the traverse direction and the protruding direction.

Figure 19:
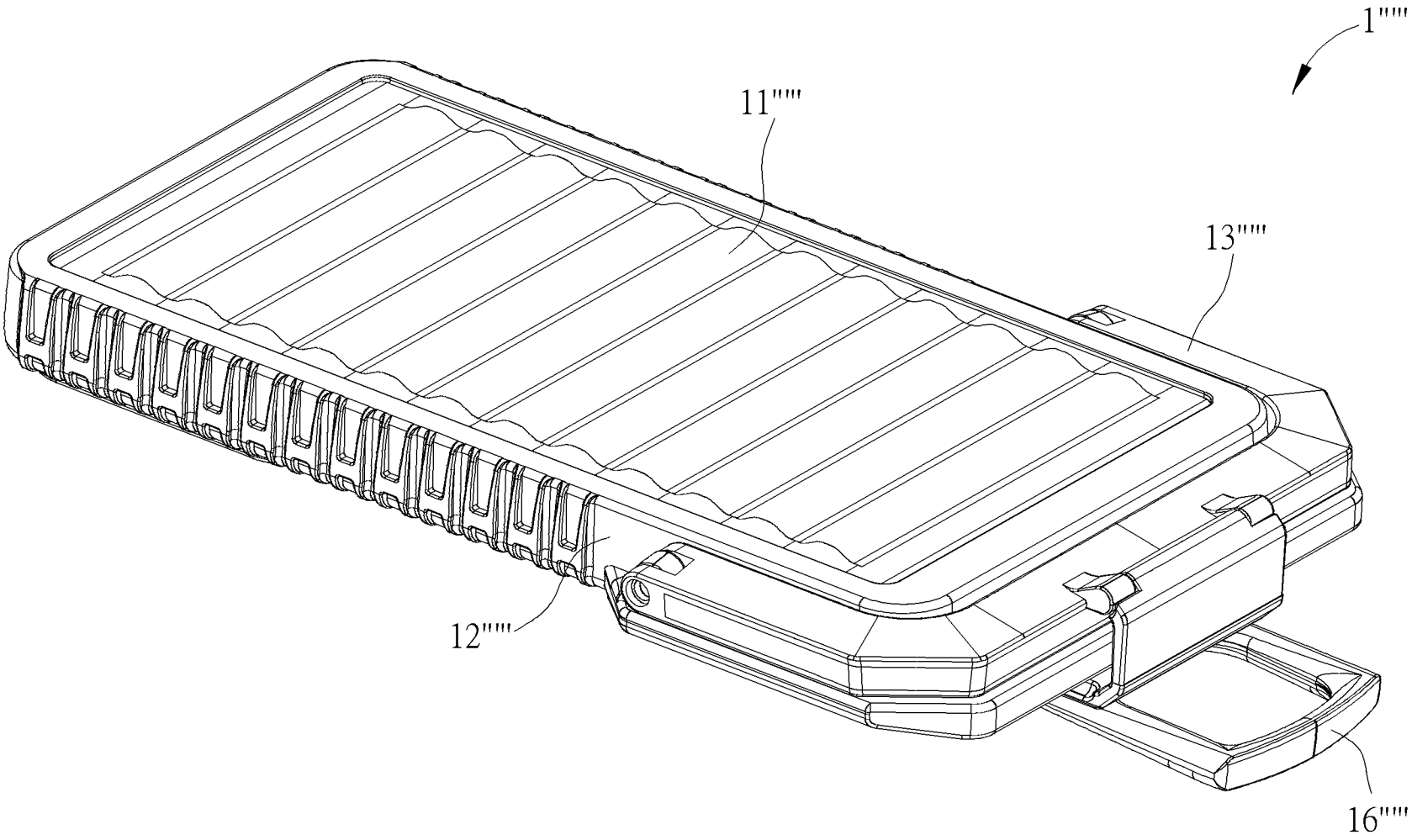
FIG. 19 to FIG. 21 are schematic diagrams of a waterproof container at different views according to a sixth embodiment of the present invention.
Figure 20:
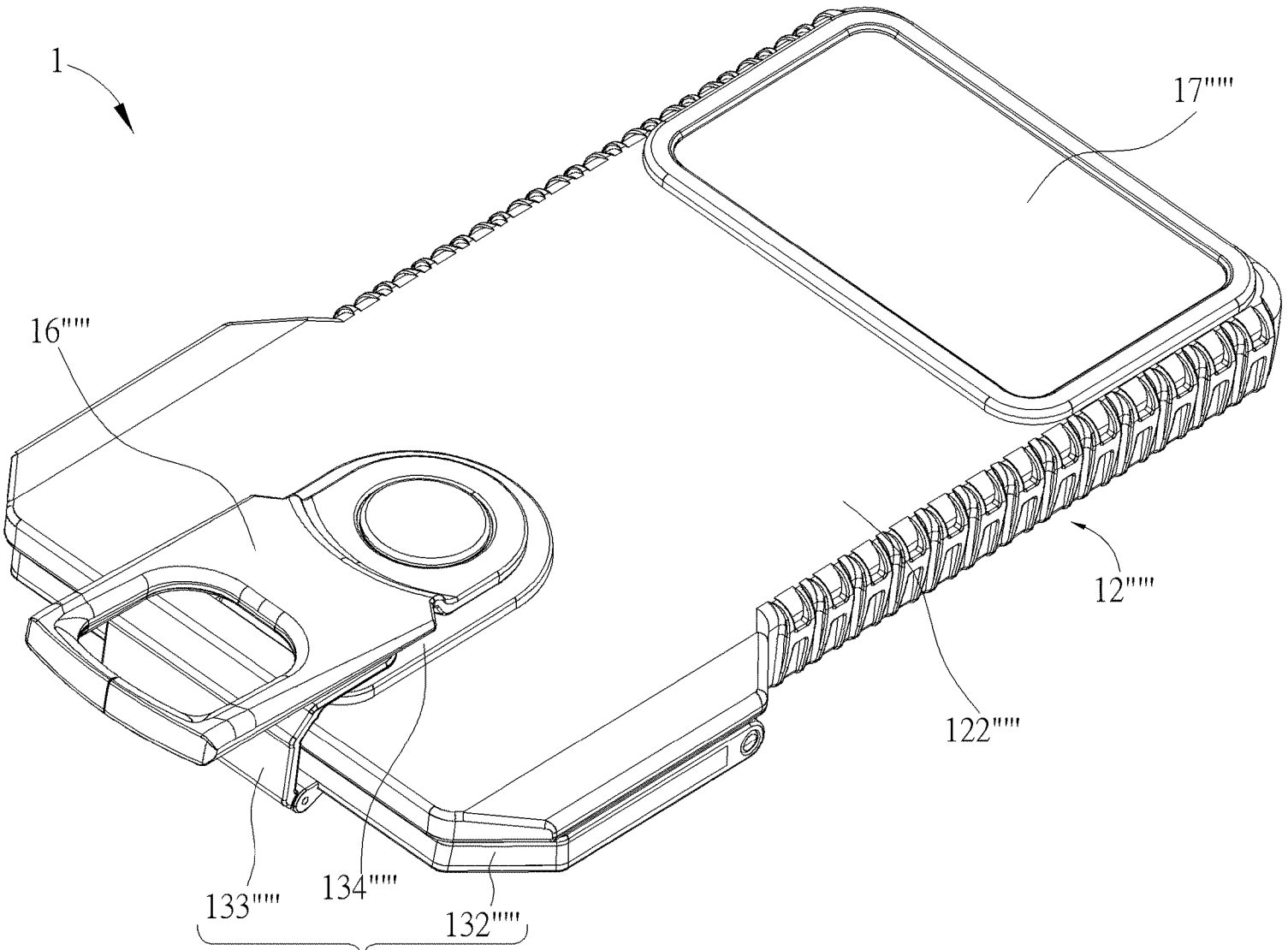
Figure 21:
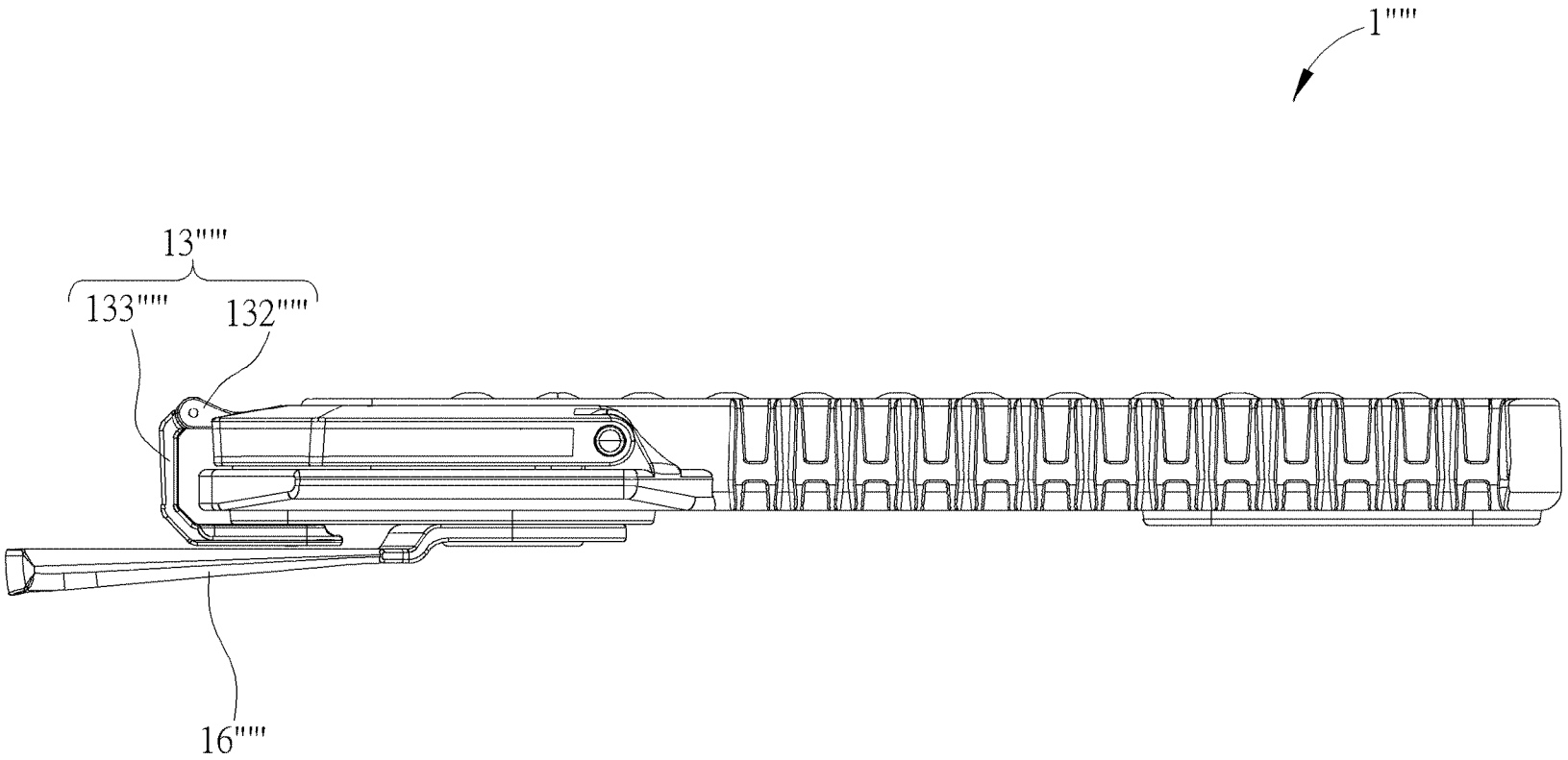
Figure 22:
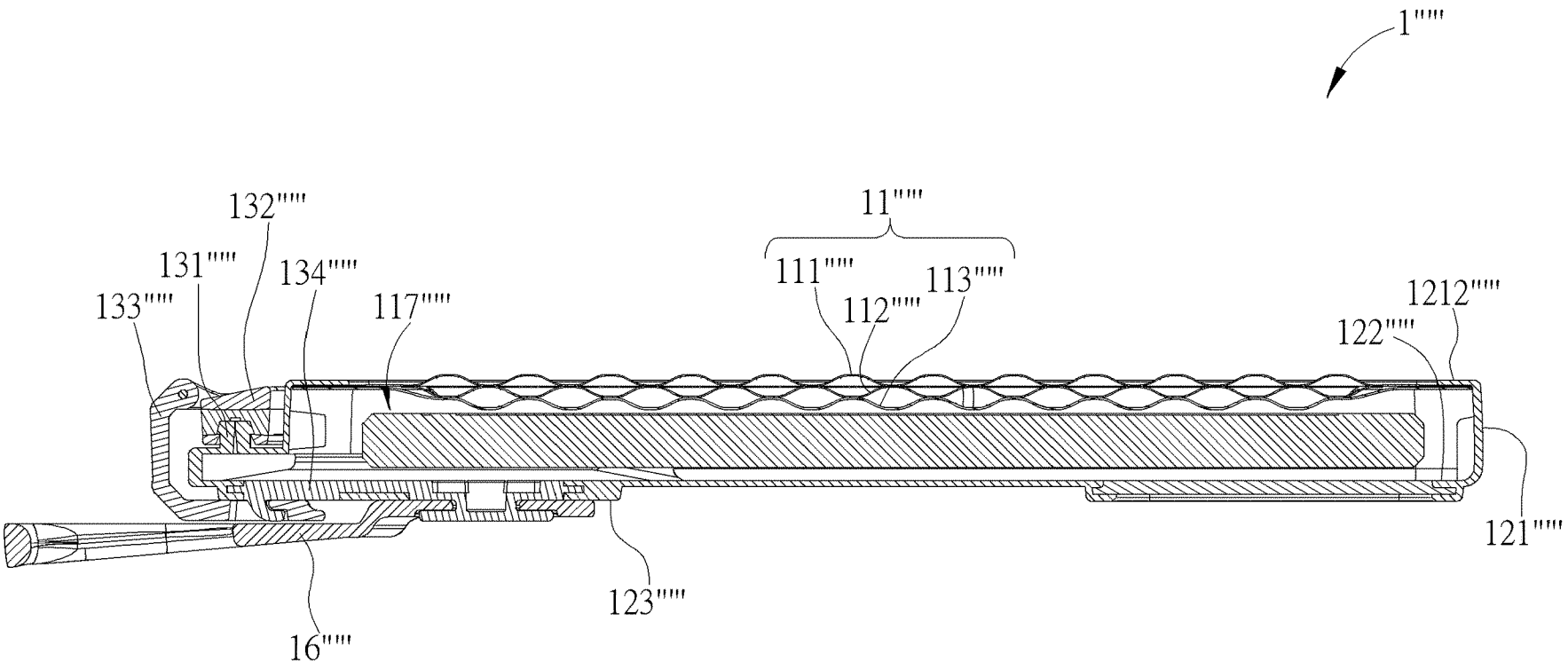
FIG. 22 is a sectional diagram of the waterproof container according the sixth embodiment of the present invention.
Figure 23:
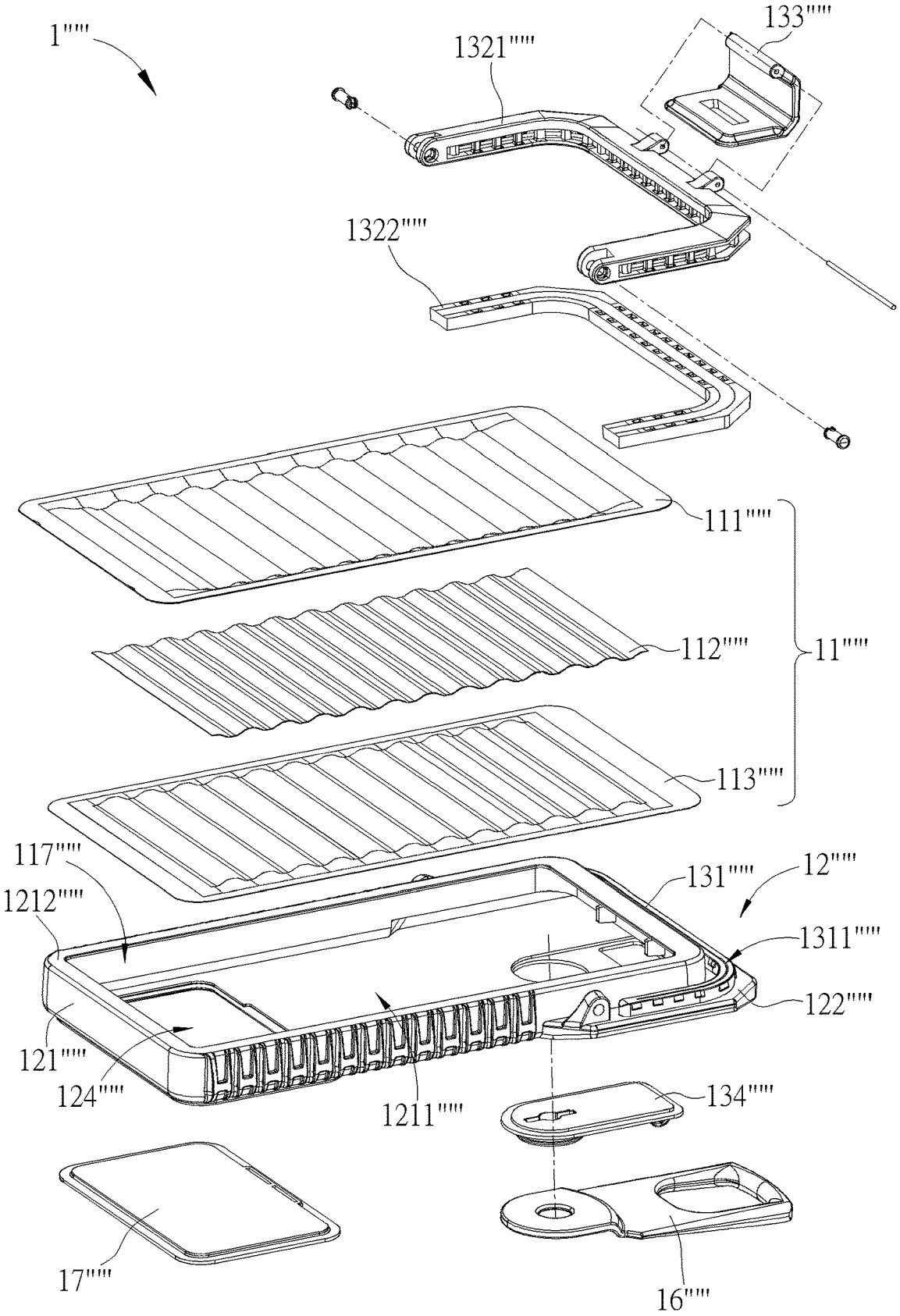
FIG. 23 is an exploded diagram of the waterproof container according the sixth embodiment of the present invention.

Please further refer to FIG. 19 to FIG. 23. FIG. 19 to FIG. 21 are schematic diagrams of a waterproof container 1''''' at different views according to a sixth embodiment of the present invention. FIG. 22 is a sectional diagram of the waterproof container 1''''' according the sixth embodiment of the present invention. FIG. 23 is an exploded diagram of the waterproof container 1''''' according the sixth embodiment of the present invention. As shown in FIG. 19 to FIG. 23, in this embodiment, the waterproof container 1''''' can be a waterproof case. An upper component 11''''' includes a first layer 111''''', a second layer 112''''' and a third layer 113''''' which is similar to the first layer 111, the second layer 112 and the third layer 113 of the first embodiment. Different from the aforementioned embodiments, a surrounding wall 121''''' protrudes from a first side 122''''' of the lower component 12'''''. An opening 1211''''' is enclosed by a connecting portion 1212''''' of the surrounding wall 121'''''. The upper component 11''''' is located at a position corresponding to the opening 1211''''', and the first layer 111''''' of the upper component 11''''' is connected to the connecting portion 1212''''' of the surrounding wall 121'''''. The waterproof container 1''''' includes a sealable opening structure 13''''' disposed on the lower component 12''''' for providing access to an accommodating space 117''''' enclosed by the lower component 12''''' and the third layer 113''''' of the upper component 11'''''.

Furthermore, the sealable opening structure 13''''' includes an elastomeric protruding component 131''''' and a covering assembly 132'''''. The elastomeric protruding component 131''''' protrudes from the first side 122''''' of the lower component 12''''' along a protruding direction parallel to a normal direction of the first side 122''''' of the lower component 12'''''. A slit 1311''''' penetrates through the elastomeric protruding component 131''''' along the protruding direction and is communicated with the accommodating space 117''''. The covering assembly 132'''' is configured to pivotally engage with the elastomeric protruding component 131'''' to seal the slit 1311''''. The covering assembly 132'''' includes a covering component 1321'''' and a sealing component 1322''''. The covering component 1321'''' is pivotally connected to the elastomeric protruding component 131''''. The covering component 1321'''' is for squeezing the elastomeric protruding component 131'''' along two different directions when the covering assembly 132'''' is engaged with the elastomeric protruding component 131''''. The sealing component 1322'''' is disposed on the covering component 1321''''. The sealing component 1322'''' is for squeezing the elastomeric protruding component 131'''' along the protruding direction when the covering assembly 132'''' is engaged with the elastomeric protruding component 131''''.

Besides, the sealable opening structure 13'''' further includes a first engaging component 133'''' and a second engaging component 134''''. The first engaging component 133'''' is pivotally coupled to the covering component 1321'''' of the covering assembly 132''''. A pivoting axis of the first engaging component 133'''' is parallel to a pivoting axis of the covering component 1321'''' of the covering assembly 132'''' and perpendicular to a normal direction of the first side 122'''' of the lower component 12''''. The second engaging component 134'''' is disposed on the lower component 12'''' and protrudes from a second side 123'''' of the lower component 12'''' opposite to the first side 122'''' of the lower component 12'''', and the first engaging component 133'''' engages with the second engaging component 134'''' for restraining the covering assembly 132'''' from disengaging from the elastomeric protruding component 131''''.

In this embodiment, the waterproof container 1'''' further includes a clip 16'''' pivotally coupled to the second side 123'''' of the lower component 12'''' by the second engaging component 134''''. A pivoting axis of the clip 16'''' is parallel to a normal direction of the second side 123'''' of the lower component 12''''. The second engaging component 134'''' is located between the clip 16'''' and the lower component 12'''', and the clip 16'''' is not only for easy carrying but also configured to pivotally reveal the second engaging component 134'''' for allowing engagement of the first engaging component 133'''' and the second engaging component 134''''. After the first engaging component 133'''' is engaged with the second engaging component 134'''', the clip 16'''' can pivot to cover the first engaging component 133'''' and the second engaging component 134'''' for preventing unintentional disengagement of the first engaging component 133'''' and the second engaging component 134''''.

In addition, the waterproof container 1'''' further includes a window 17''''. An aperture structure 124'''' is formed on the lower component 12'''', and the window 17'''' is disposed on the aperture structure 124'''' and can be transparent for allowing a camera of the electronic device to capture images.

However, the present invention is not limited to this embodiment. For example, in another embodiment, the elastomeric protruding component can protrude from the second side of the lower component, i.e., the elastomeric protruding component and the upper component are located at two opposite sides of the lower component. The first engaging component can be pivotally coupled to the covering assembly adjacent to the first side of the lower component. The second engaging component can protrude from the first side of the lower component. The clip can be pivotally coupled to the first side of the lower component. The pivoting axis of the first engaging component can be perpendicular to the normal direction of the second side of the lower component, and the pivoting axis of the clip can be parallel to the normal direction the first side of the lower component.

In contrast to the prior art, in the present invention, when the touched portion of the upper component is collapsed by the user's finger underwater, the untouched portion of the upper component is not collapsed due to the staggered arrangement of the plurality of first connections and the plurality of second connections. Furthermore, when the fluid is forced by the user's finger to flow inside the enclosing space, the plurality of first connections and the plurality of second connections can prevent excessive inflation and excessive deflation of the untouched portion of the upper component, so as to prevent abnormal excessive accumulation and loss of the fluid to prevent collapse of the untouched portion of the upper component caused by the abnormal accumulation and loss of the fluid. Therefore, the first portion of the touch screen corresponding to the touch portion of the upper component is close to the user's finger, and the second portion of the touch screen corresponding to the untouched portion of the upper component is still away from water, which prevents the desired touch operation of the first portion of the touch screen from being interfered by the unintentional touch operation of the second portion of the touch screen caused by the water.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A waterproof container adapted for an electronic device with a touch screen, the waterproof container comprising:

an upper component, the upper component comprising a first layer, a second layer and a third layer, a second touched part of the second layer being disposed between a first touched part of the first layer and a third touched part of the third layer, the second touched part of the second layer being connected to the first touched part of the first layer by a plurality of first connections, the second touched part of the second layer being connected to the third touched part of the third layer by a plurality of second connections, and the plurality of first connections and the plurality of second connections being staggered relative to each other; and a lower component connected to the upper component, an accommodating space being enclosed by the lower component and the upper component for accommodating the electronic device.

2. The waterproof container of claim 1, wherein the first touched part of the first layer is separated from the third touched part of the third layer by the second touched part of the second layer and spaced from the third touched part of the third layer at a uniform distance.

3. The waterproof container of claim 1, wherein the plurality of first connections and the plurality of second connections are staggered relative to each other along a longitudinal direction of the upper component.

4. The waterproof container of claim 3, wherein the plurality of first connections and the plurality of second connections are line-shaped connections extending along a traverse direction of the upper component.

5. The waterproof container of claim 1, wherein the plurality of first connections and the plurality of second connections are staggered relative to each other along a longitudinal direction and a traverse direction of the upper component.

6. The waterproof container of claim 5, wherein the plurality of first connections and the plurality of second connections are dot-shaped connections.

7. The waterproof container of claim 1, wherein each of the first touched part of the first layer, the second touched part of the second layer and the third touched part of the third layer is formed in a wave-shaped structure.

8. The waterproof container of claim 1, further comprising a sealable opening structure for providing access to the accommodating space.

9. The waterproof container of claim 1, further comprising an inflating pump for inflating an enclosing space enclosed by the first layer and the third layer with a fluid by allowing the fluid to flow into the enclosing space enclosed by the first layer and the third layer.

10. The waterproof container of claim 9, wherein the accommodating space is enclosed by the lower component and the third layer, and the inflating pump inflates the enclosing space enclosed by the first layer and the third layer with the fluid by allowing the fluid to flow from the accommodating space enclosed by the lower component and the third layer to the enclosing space enclosed by the first layer and the third layer.

11. The waterproof container of claim 9, wherein the inflating pump inflates the enclosing space enclosed by the first layer and the third layer with the fluid by allowing the fluid to flow from an environment outside the waterproof container to the enclosing space enclosed by the first layer and the third layer.

12. The waterproof container of claim 1, further comprising a relief valve for deflating the enclosing space enclosed by the first layer and the third layer by allowing a fluid to flow out of the enclosing space enclosed by the first layer and the third layer.

13. The waterproof container of claim 12, wherein the accommodating space is enclosed by the lower component and the third layer, and the relief valve deflates the enclosing space enclosed by the first layer and the third layer by allowing the fluid to flow from the enclosing space enclosed by the first layer and the third layer to the accommodating space enclosed by the lower component and the third layer.

14. The waterproof container of claim 12, wherein the relief valve deflates the enclosing space enclosed by the first layer and the third layer by allowing the fluid to flow from the accommodating space enclosed by the lower component and the third layer to an environment outside the waterproof container.

15. The waterproof container of claim 1, wherein the upper component further comprises a fourth layer, a fourth touched part of the fourth layer is connected to the third touched part of the third layer by a plurality of third connections, and the plurality of second connections and the plurality of third connections are staggered relative to each other.

16. The waterproof container of claim 15, wherein the upper component further comprises a fifth layer, a fifth touched part of the fifth layer is connected to the fourth touched part of the fourth layer by a plurality of fourth connections, and the plurality of third connections and the plurality of fourth connections are staggered relative to each other.

17. The waterproof container of claim 16, wherein an enclosing space is enclosed by the first layer and the fifth layer, and the accommodating space is enclosed by the lower component and the fifth layer.

18. The waterproof container of claim 1, wherein the plurality of first connections and the plurality of second connections are staggered relative to each other along a longitudinal direction of the upper component and are line-shaped connections extending along a traverse direction of the upper component.

19. The waterproof container of claim 1, wherein the plurality of first connections and the plurality of second connections are staggered relative to each other along a longitudinal direction and a traverse direction of the upper component and are dot-shaped connections.

20. The waterproof container of claim 16, wherein each of the first touched part of the first layer, the second touched part of the second layer, the third touched part of the third layer, the fourth touched part of the fourth layer and the fifth touched part of the fifth layer is formed in a wave-shaped structure.

21. The waterproof container of claim 1, wherein the lower component is a flat film, and the waterproof container further comprises a sealable opening structure disposed on the upper component for providing access to the accommodating space.

22. The waterproof container of claim 21, wherein the sealable opening structure comprises:

an elastomeric protruding component protruding from the upper component, a slit penetrating through the elastomeric protruding component and being communicated with the accommodating space; and a covering assembly configured to pivotally engage with the elastomeric protruding component to seal the slit.

23. The waterproof container of claim 1, wherein a surrounding wall protrudes from a first side of the lower component, an opening is enclosed by a connecting portion of the surrounding wall, the upper component is located at a position corresponding to the opening and connected to the connecting portion of the surrounding wall, and the waterproof container further comprises a sealable opening structure disposed on the lower component for providing access to the accommodating space.

24. The waterproof container of claim 23, wherein the sealable opening structure comprises:

an elastomeric protruding component protruding from one of the first side of the lower component and a second side of the lower component opposite to the first side of the lower component, a slit penetrating through the elastomeric protruding component and being communicated with the accommodating space; and a covering assembly configured to pivotally engage with the elastomeric protruding component to seal the slit.

25. The waterproof container of claim 24, wherein the sealable opening structure further comprises:

a first engaging component pivotally coupled to the covering assembly, a pivoting axis of the first engaging component being parallel to a pivoting axis of the covering assembly and perpendicular to a normal direction of the one of the first side and the second side of the lower component; and a second engaging component protruding from another one of the first side and the second side of the lower component, and the first engaging component engaging with the second engaging component for restraining the covering assembly from disengaging from the elastomeric protruding component.

26. The waterproof container of claim 25, further comprising a clip pivotally coupled to the another one of the first side and second side of the lower component, a pivoting axis of the clip being parallel to a normal direction of the another one of the first side and the second side of the lower component, the second engaging component being located between the clip and the lower component, and the clip being configured to pivotally reveal the second engaging component or pivotally cover the second engaging component.

27. The waterproof container of claim 23, further comprising a window, an aperture structure being formed on the lower component, and the window being disposed on the aperture structure.

* * * * *